US011127408B2

(12) United States Patent
Ravelli et al.

(10) Patent No.: US 11,127,408 B2
(45) Date of Patent: Sep. 21, 2021

(54) TEMPORAL NOISE SHAPING

(71) Applicant: Fraunhofer—Gesellschaft zur Förderung der angewandten Forschung e.V., Munich (DE)

(72) Inventors: Emmanuel Ravelli, Erlangen (DE); Manfred Lutzky, Erlangen (DE); Markus Schnell, Erlangen (DE); Alexander Tschekalinskij, Erlangen (DE); Goran Markovic, Erlangen (DE); Stefan Geyersberger, Erlangen (DE)

(73) Assignee: Fraunhofer—Gesellschaft zur F rderung der angewandten Forschung e.V., Munich (DE)

( * ) Notice: Subject to any disclaimer, the term of this patent is extended or adjusted under 35 U.S.C. 154(b) by 0 days.

(21) Appl. No.: 16/868,954

(22) Filed: May 7, 2020

(65) Prior Publication Data

US 2020/0265850 A1 Aug. 20, 2020

Related U.S. Application Data

(63) Continuation of application No. PCT/EP2018/080339, filed on Nov. 6, 2018.

(30) Foreign Application Priority Data

Nov. 10, 2017 (EP) ..... 17201094

(51) Int. Cl.
*G10L 19/03* (2013.01)
*G10L 21/0364* (2013.01)

(52) U.S. Cl.
CPC ..... *G10L 19/03* (2013.01); *G10L 21/0364* (2013.01)

(58) Field of Classification Search
CPC ..... G10L 19/03; G10L 21/0364
See application file for complete search history.

(56) References Cited

U.S. PATENT DOCUMENTS 4,972,484 A 11/1990 Link et al.
5,012,517 A 4/1991 Chhatwal et al.
(Continued)

FOREIGN PATENT DOCUMENTS

CN 101140759 A 3/2008
CN 102779526 A 11/2012
(Continued)

OTHER PUBLICATIONS

ETSI TS 126 445 V13.2.0 (Aug. 2016), Universal Mobile Telecommunications System (UMTS); LTE; Codec for Enhanced Voice Services (EVS); Detailed algorithmic description (3GPP TS 26.445 version 13.2.0 Release 13) [Online]. Available: http://www.3gpp.org/ftp/Specs/archive/26_series/26.445/26445-d00.zip.
(Continued)

*Primary Examiner* — Feng-Tzer Tzeng
(74) *Attorney, Agent, or Firm* — Novick, Kim & Lee, PLLC; Jae Youn Kim; Jihun Kim

(57) ABSTRACT

In methods and apparatus for performing temporal noise shaping, an apparatus may have a temporal noise shaping, TNS, tool for performing linear prediction, LP, filtering on an information signal including a plurality of frames; and a controller configured to control the TNS tool so that the TNS tool performs LP filtering with: a first filter whose impulse response has a higher energy; and a second filter whose impulse response has a lower energy than the first filter, wherein the second filter is not an identity filter, wherein the controller is configured to choose between filtering with the first filter, and filtering with the second filter on the basis of a frame metrics.

22 Claims, 13 Drawing Sheets

(56) References Cited

U.S. PATENT DOCUMENTS 5,548,680 A 8/1996 Cellario
5,581,653 A 12/1996 Todd
5,651,091 A 7/1997 Chen et al.
5,781,888 A 7/1998 Herre
5,812,971 A 9/1998 Herre
5,819,209 A 10/1998 Inoue
5,909,663 A 6/1999 Iijima et al.
5,999,899 A 12/1999 Robinson
6,018,706 A 1/2000 Huang et al.
6,148,288 A 11/2000 Park
6,507,814 B1 1/2003 Gao
6,570,991 B1 5/2003 Scheirer et al.
6,735,561 B1 * 5/2004 Johnston ..... G10L 19/03 381/94.3
7,009,533 B1 3/2006 Wegener
7,353,168 B2 4/2008 Chen et al.
7,395,209 B1 7/2008 Dokic et al.
7,539,612 B2 5/2009 Chen et al.
7,546,240 B2 6/2009 Chen et al.
8,015,000 B2 9/2011 Chen et al.
8,095,359 B2 1/2012 Boehm et al.
8,280,538 B2 10/2012 Kim et al.
8,473,301 B2 6/2013 Chen et al.
8,543,389 B2 9/2013 Ragot et al.
8,554,549 B2 10/2013 Morii et al.
8,612,240 B2 12/2013 Fuchs et al.
8,682,681 B2 3/2014 Fuchs et al.
8,738,385 B2 5/2014 Chen
8,751,246 B2 6/2014 Bayer et al.
8,847,795 B2 9/2014 Faure et al.
8,891,775 B2 * 11/2014 Schug ..... H04S 1/007 381/1
8,898,068 B2 11/2014 Fuchs et al.
9,123,350 B2 9/2015 Zhao et al.
9,489,961 B2 * 11/2016 Ragot ..... H04B 1/62
9,595,262 B2 3/2017 Fuchs et al.
10,726,854 B2 7/2020 Ghido et al.
2003/0101050 A1 5/2003 Cuperman et al.
2005/0015249 A1 1/2005 Chen et al.
2006/0288851 A1 12/2006 Kawamura et al.
2007/0033056 A1 2/2007 Groeschl et al.
2007/0118369 A1 5/2007 Chen
2007/0127729 A1 6/2007 Breebaart et al.
2007/0129940 A1 6/2007 Geyersberger et al.
2007/0276656 A1 11/2007 Solbach et al.
2008/0033718 A1 2/2008 Chen et al.
2008/0126086 A1 5/2008 Kandhadai et al.
2008/0126096 A1 5/2008 Choo et al.
2009/0076805 A1 3/2009 Du et al.
2009/0076830 A1 3/2009 Taleb
2009/0138267 A1 5/2009 Davidson et al.
2009/0254352 A1 10/2009 Zhao
2010/0010810 A1 1/2010 Morii
2010/0070270 A1 3/2010 Gao
2010/0094637 A1 4/2010 Vinton
2010/0115370 A1 5/2010 Ramo et al.
2010/0198588 A1 8/2010 Osada et al.
2010/0312552 A1 12/2010 Kandhadai et al.
2010/0312553 A1 12/2010 Fang et al.
2010/0324912 A1 12/2010 Oh et al.
2011/0015768 A1 1/2011 Kim et al.
2011/0019829 A1 1/2011 Morii
2011/0022924 A1 1/2011 Malenovsky et al.
2011/0035212 A1 2/2011 Briand et al.
2011/0060597 A1 3/2011 Chen et al.
2011/0071839 A1 3/2011 Budnikov et al.
2011/0095920 A1 4/2011 Ashley et al.
2011/0096830 A1 4/2011 Ashley et al.
2011/0116542 A1 5/2011 Antonini et al.
2011/0125505 A1 5/2011 Gournay et al.
2011/0145003 A1 6/2011 Bessette
2011/0196673 A1 8/2011 Park et al.
2011/0200198 A1 8/2011 Bayer et al.
2011/0238425 A1 9/2011 Lecomte et al.
2011/0238426 A1 9/2011 Borsum et al.
2012/0010879 A1 1/2012 Kikuiri et al.
2012/0022881 A1 1/2012 Geiger et al.
2012/0109659 A1 5/2012 Chen et al.
2012/0214544 A1 8/2012 Rodriguez et al.
2012/0245947 A1 9/2012 Baeckstroem et al.
2012/0265540 A1 10/2012 Fuchs et al.
2013/0030819 A1 1/2013 Carlsson et al.
2013/0226594 A1 8/2013 Fuchs et al.
2013/0282369 A1 10/2013 Ryu et al.
2014/0052439 A1 2/2014 Nanjundaswamy et al.
2014/0067404 A1 3/2014 Baumgarte
2014/0074486 A1 3/2014 Dietz et al.
2014/0108020 A1 4/2014 Bai et al.
2014/0142957 A1 5/2014 Lee et al.
2014/0358531 A1 12/2014 Vos
2015/0010155 A1 1/2015 Lang et al.
2015/0081312 A1 3/2015 Fuchs et al.
2015/0142452 A1 5/2015 Lee et al.
2015/0154969 A1 6/2015 Craven et al.
2015/0170668 A1 * 6/2015 Kovesi ..... G10L 21/0364 381/66
2015/0221311 A1 8/2015 Jeon et al.
2015/0228287 A1 8/2015 Bruhn et al.
2015/0302859 A1 10/2015 Aguilar et al.
2015/0325246 A1 11/2015 Chen et al.
2015/0371647 A1 12/2015 Faure et al.
2016/0027450 A1 1/2016 Gao
2016/0189721 A1 6/2016 Johnston et al.
2016/0225384 A1 8/2016 Kjörling et al.
2016/0285718 A1 9/2016 Bruhn
2016/0293175 A1 10/2016 Atti et al.
2016/0307576 A1 10/2016 Doehla et al.
2016/0365097 A1 12/2016 Guan et al.
2016/0372125 A1 12/2016 Atti et al.
2016/0372126 A1 12/2016 Atti et al.
2016/0379655 A1 12/2016 Truman et al.
2017/0011747 A1 1/2017 Faure et al.
2017/0053658 A1 2/2017 Atti et al.
2017/0078794 A1 3/2017 Bongiovi et al.
2017/0103769 A1 4/2017 Laaksonen et al.
2017/0110135 A1 4/2017 Disch et al.
2017/0133029 A1 5/2017 Doehla et al.
2017/0140769 A1 5/2017 Dietz et al.
2017/0154631 A1 6/2017 Bayer et al.
2017/0154635 A1 6/2017 Doehla et al.
2017/0221495 A1 8/2017 Oh et al.
2017/0236521 A1 8/2017 Atti et al.
2017/0294196 A1 10/2017 Bradley et al.

FOREIGN PATENT DOCUMENTS

CN 107103908 A 8/2017
CN 104269173 B 3/2018
EP 0716787 A1 6/1996
EP 0732687 B2 9/1996
EP 797324 B1 11/2004
EP 785631 B1 3/2007
EP 1791115 A2 5/2007
EP 2264698 A4 6/2012
EP 2676266 B1 12/2013
EP 2980796 A1 2/2016
EP 2980799 A1 2/2016
EP 3111624 A1 1/2017
FR 2944664 A1 10/2010
JP H05-281996 A 10/1993
JP H07-28499 A 1/1995
JP H9-204197 A 8/1997
JP H10-51313 A 2/1998
JP H1091194 A 4/1998
JP 2004-138756 A 5/2004
JP 2006-527864 A 12/2006
JP 2007-525718 A 9/2007
JP 2009-003387 A 1/2009
JP 2009-008836 A 1/2009
JP 2009-538460 A 11/2009
JP 2010-500631 A 1/2010
JP 2010-501955 A 1/2010
JP 2012-533094 A 12/2012
JP 2016-200750 A 12/2016

(56) References Cited

FOREIGN PATENT DOCUMENTS

| | | | |
|---|---|---|---|
| JP | 2017-522604 | A | 8/2017 |
| KR | 100261253 | B1 | 7/2000 |
| KR | 20030031936 | A | 4/2003 |
| KR | 20170000933 | A | 1/2017 |
| RU | 2337414 | C2 | 10/2008 |
| RU | 2376657 | C2 | 12/2009 |
| RU | 2413312 | C2 | 2/2011 |
| RU | 2419891 | C2 | 5/2011 |
| RU | 2439718 | C1 | 1/2012 |
| RU | 2483365 | C2 | 5/2013 |
| RU | 2520402 | C2 | 6/2014 |
| RU | 2568381 | C2 | 11/2015 |
| RU | 2591661 | C2 | 7/2016 |
| RU | 2596594 | C2 | 9/2016 |
| RU | 2596596 | C2 | 9/2016 |
| RU | 2015136540 | A | 3/2017 |
| RU | 2628162 | C2 | 8/2017 |
| RU | 2016105619 | A | 8/2017 |
| TW | 200809770 | A | 2/2008 |
| TW | 201005730 | A | 2/2010 |
| TW | 201126510 | A | 8/2011 |
| TW | 201131550 | A | 9/2011 |
| TW | 201207839 | A | 2/2012 |
| TW | 201243832 | A | 11/2012 |
| TW | 201612896 | A | 4/2016 |
| TW | 201618080 | A | 5/2016 |
| TW | 201618086 | A | 5/2016 |
| TW | 201642246 | A | 12/2016 |
| TW | 201642247 | A | 12/2016 |
| TW | 201705126 | A | 2/2017 |
| TW | 201711021 | A | 3/2017 |
| TW | 201713061 | A | 4/2017 |
| TW | 201724085 | A | 7/2017 |
| TW | 201732779 | A | 9/2017 |
| WO | 9916050 | A1 | 4/1999 |
| WO | 2004/072951 | A1 | 8/2004 |
| WO | 2005/086138 | A1 | 9/2005 |
| WO | 2005/086139 | A1 | 9/2005 |
| WO | 2007/073604 | A1 | 7/2007 |
| WO | 2007/138511 | A1 | 12/2007 |
| WO | 2008/025918 | A1 | 3/2008 |
| WO | 2008/046505 | A1 | 4/2008 |
| WO | 2009/066869 | A1 | 5/2009 |
| WO | 2011/048118 | A1 | 4/2011 |
| WO | 2011/086066 | A1 | 7/2011 |
| WO | 2011/086067 | A1 | 7/2011 |
| WO | 2012/000882 | A | 1/2012 |
| WO | 2012/000882 | A1 | 1/2012 |
| WO | 2012/126893 | A | 9/2012 |
| WO | 2014/165668 | A | 10/2014 |
| WO | 2014/202535 | A | 12/2014 |
| WO | 2014/202535 | A1 | 12/2014 |
| WO | 2015/063045 | A1 | 5/2015 |
| WO | 2015/063227 | A1 | 5/2015 |
| WO | 2015/071173 | A1 | 5/2015 |
| WO | 2015/174911 | A1 | 11/2015 |
| WO | 2016/016121 | A1 | 2/2016 |
| WO | 2016/142337 | A1 | 9/2016 |

OTHER PUBLICATIONS

Geiger, "Audio Coding based on integer transform", Ilmenau: https://www.db-thueringen.de/receive/dbt_mods_00010054, 2004.

Henrique S Malvar, "Biorthogonal and Nonuniform Lapped Transforms for Transform Coding with Reduced Blocking and Ringing Artifacts", IEEE Transactions on Signal Processing, IEEE Service Center, New York, NY, US, (Apr. 1998), vol. 46, No. 4, ISSN 1053-587X, XP011058114.

Anonymous, "ISO/IEC 14496-3:2005/FDAM 9, AAC-ELD", 82. MPEG Meeting;Oct. 22, 2007-Oct. 26, 2007; Shenzhen; (Motion Picture Expert Group or ISO/IEC JTC1/SC29/WG11),, (Feb. 21, 2008), No. N9499, XP030015994.

Virette, "Low Delay Transform for High Quality Low Delay Audio Coding", Université de Rennes 1, (Dec. 10, 2012), pp. 1-195, URL: https://hal.inria.fr/tel-01205574/document, (Mar. 30, 2016), XP055261425.

ISO/IEC 14496-3:2001; Information technology—Coding of audio-visual objects—Part 3: Audio.

3GPP TS 26.403 v14.0.0 (Mar. 2017); General audio codec audio processing functions; Enhanced acPlus general audio codec; Encoder specification; Advanced Audio Coding (AAC) part; (Release 14).

ISO/IEC 23003-3; Information technology—MPEG audio technologies—Part 3: Unified speech and audio coding, 2011.

3GPP TS 26.445 V14.1.0 (Jun. 2017), 3rd Generation Partnership Project; Technical Specification Group Services and System Aspects; Codec for Enhanced Voice Services (EVS); Detailed Algorithmic Description (Release 14), http://www.3gpp.org/ftp//Specs/archive/26_series/26.445/26445-e10.zip, Section 5.1.6 "Bandwidth detection".

Eksler Vaclav et al, "Audio bandwidth detection in the EVS codec", 2015 IEEE Global Conference on Signal and Information Processing (Globalsip), IEEE, (Dec. 14, 2015), doi:10.1109/GLOBALSIP.2015.7418243, pp. 488-492, XP032871707.

Oger M et al, "Transform Audio Coding with Arithmetic-Coded Scalar Quantization and Model-Based Bit Allocation", International Conference on Acoustics, Speech, and Signalprocessing, IEEE, XX,Apr. 15, 2007 (Apr. 15, 2007), p. IV-545, XP002464925.

Asad et al., "An enhanced least significant bit modification technique for audio steganography", International Conference on Computer Networks and Information Technology, Jul. 11-13, 2011.

Makandar et al, "Least Significant Bit Coding Analysis for Audio Steganography", Journal of Future Generation Computing, vol. 2, No. 3, Mar. 2018.

ISO/IEC 23008-3:2015; Information technology—High efficiency coding and media delivery in heterogeneous environments—Part 3: 3D audio.

ITU-T G.718 (Jun. 2008): Series G: Transmission Systems and Media, Digital Systems and Networks, Digital terminal equipments—Coding of voice and audio signals, Frame error robust narrow-band and wideband embedded variable bit-rate coding of speech and audio from 8-32 kbit/s.

3GPP TS 26.447 V14.1.0 (Jun. 2017), Technical Specification, 3rd Generation Partnership Project; Technical Specification Group Services and System Aspects; Codec for Enhanced Voice Services (EVS); Error Concealment of Lost Packets (Release 14).

DVB Organization, "ISO-IEC_23008-3_A3_(E)_(H 3DA FDAM3).docx", DVB, Digital Video Broadcasting, C/O EBU—17A Ancienne Route—CH-1218 Grand Saconnex, Geneva—Switzerland, (Jun. 13, 2016), XP017851888.

Hill et al., "Exponential stability of time-varying linear systems," Ima J Numer Anal, pp. 865-885, 2011.

3GPP TS 26.090 V14.0.0 (Mar. 2017), 3rd Generation Partnership Project; Technical Specification Group Services and System Aspects; Mandatory Speech Codec speech processing functions; Adaptive Multi-Rate (AMR) speech codec; Transcoding functions (Release 14).

3GPP TS 26.190 V14.0.0 (Mar. 2017), Technical Specification, 3rd Generation Partnership Project; Technical Specification Group Services and System Aspects; Speech codec speech processing functions; Adaptive Multi-Rate-Wideband (AMR-WB) speech codec; Transcoding functions (Release 14).

3GPP TS 26.290 V14.0.0 (Mar. 2017), Technical Specification, 3rd Generation Partnership Project; Technical Specification Group Services and System Aspects; Audio codec processing functions; Extended Adaptive Multi-Rate-Wideband (AMR-WB-F) codec; Transcoding functions (Release 14).

Edler et al., "Perceptual Audio Coding Using a Time-Varying Linear Pre- and Post-Filter," in AES 109th Convention, Los Angeles, 2000.

Gray et al., "Digital lattice and ladder filter synthesis," IEEE Transactions on Audio and Electroacoustics, vol. vol. 21, no. No. 6, pp. 491-500, 1973.

Lamoureux et al., "Stability of time variant filters," CREWES Research Report—vol. 19, 2007.

Herre et al., "Enhancing the performance of perceptual audio coders by using temporal noise shaping (TNS)." Audio Engineering Society Convention 101. Audio Engineering Society, 1996.

(56) References Cited

OTHER PUBLICATIONS

Herre et al., "Continuously signal-adaptive filterbank for high-quality perceptual audio coding." Applications of Signal Processing to Audio and Acoustics, 1997. 1997 IEEE ASSP Workshop on. IEEE, 1997.

Herre, "Temporal noise shaping, quantization and coding methods in perceptual audio coding: A tutorial introduction." Audio Engineering Society Conference: 17th International Conference: High-Quality Audio Coding. Audio Engineering Society, 1999.

Fuchs Guillaume et al, "Low delay LPC and MDCT-based audio coding in the EVS codec", 2015 IEEE International Conference on Acoustics, Speech and Signal Processing (ICASSP), IEEE, (Apr. 19, 2015), doi:10.1109/ICASSP.2015.7179068, pp. 5723-5727, XP033187858.

Niamut et al, "RD Optimal Temporal Noise Shaping for Transform Audio Coding", Acoustics, Speech and Signal Processing, 2006. ICASSP 2006 Proceedings. 2006 IEEE International Conference on Toulouse, France May 14-19, 2006, Piscataway, NJ, USA,IEEE, Piscataway, NJ, USA, (Jan. 1, 2006), doi:10.1109/ICASSP.2006.1661244, ISBN 978-1-4244-0469-8, pp. V-V, XP031015996.

ITU-T G.711 (Sep. 1999): Series G: Transmission Systems and Media, Digital Systems and Networks, Digital transmission systems—Terminal equipments—Coding of analogue signals by pulse code modulation, Pulse code modulation (PCM) of voice frequencies, Appendix I: A high quality low-complexity algorithm for packet loss concealment with G.711.

Cheveigne et al.,"YIN, a fundamental frequency estimator for speech and music." The Journal of the Acoustical Society of America 111.4 (2002): 1917-1930.

Ojala P et al, "A novel pitch-lag search method using adaptive weighting and median filtering", Speech Coding Proceedings, 1999 IEEE Workshop on Porvoo, Finland Jun. 20-23, 1999, Piscataway, NJ, USA, IEEE, US, (Jun. 20, 1999), doi:10.1109/SCFT.1999.781502, ISBN 978-0-7803-5651-1, pp. 114-116, XP010345546.

"5 Functional description of the encoder", Dec. 10, 2014 (Dec. 10, 2014), 3GPP Standard; 26445-C10_1_S05_S0501, 3rd Generation Partnership Project (3GPP)?, Mobile Competence Centre ; 650, Route Lucioles ; F-06921 Sophia-Antipolis Cedex ; France Retrieved from the Internet:URL: http://www.3gpp.org/ftp/Specs/2014-12/Rel-12/26_series/ XP050907035.

Rospatent Examiner, "Decision on Grant Patent for Invention for RU Application No. 2020118949", dated Nov. 11, 2020, Rospatent, Russia.

O.E. Groshev, "Office Action for RU Application No. 2020118947", dated Dec. 1, 2020, Rospatent, Russia.

O.I. Starukhina, "Office Action for RU Application No. 2020118968", dated Dec. 23, 2020, Rospatent, Russia.

P.A. Volkov, "Office Action for RU Application No. 2020120251", dated Oct. 28, 2020, Rospatent, Russia.

P.A. Volkov, "Office Action for RU Application No. 2020120256", dated Oct. 28, 2020, Rospatent, Russia.

D.V.Travnikov, "Decision on Grant for RU Application No. 2020118969", dated Nov. 2, 2020, Rospatent, Russia.

Santosh Mehtry, "Office Action for IN Application No. 202037019203", dated Mar. 19, 2021, Intellectual Property India, India.

Guojun Lu et al., "A Technique towards Automatic Audio Classification and Retrieval, Forth International Conference on Signal Processing", 1998, IEEE, Oct. 12, 1998, pp. 1142-1145.

Hiroshi Ono, "Office Action for JP Application No. 2020-526135", dated May 21, 2021, JPO Japan.

Tomonori Kikuchi, "Office Action for JP Application No. 2020-524874", dated Jun. 2, 2021, JPO Japan.

Mao Xiaohong, "Office Action for SG Application No. 11202004173P", dated Jul. 23, 2021, IPOS, Singapore.

Takeshi Yamashita, "Office Action for JP Application 2020-524877", dated Jun. 24, 2021, JPO, Japan.

Tetsuyuki Okumachi, "Office Action for JP Application 2020-118837", dated Jul. 14, 2021, JPO, Japan.

Tetsuyuki Okumachi, "Office Action for JP Application 2020-118838", dated Jul. 14, 2021, JPO, Japan.

* cited by examiner

TEMPORAL NOISE SHAPING

CROSS-REFERENCE TO RELATED APPLICATIONS

This application is a continuation of copending International Application No. PCT/EP2018/080339, filed Nov. 6, 2018, which is incorporated herein by reference in its entirety, and additionally claims priority from European Application No. EP 17 201 094.4, filed Nov. 10, 2017, which is incorporated herein by reference in its entirety.

TECHNICAL FIELD

Examples herein relate to encoding and decoding apparatus, in particular for performing temporal noise shaping (TNS).

KNOWN TECHNOLOGY

The following documents are in the known technology:

[1] Herre, Jurgen, and James D. Johnston. "Enhancing the performance of perceptual audio coders by using temporal noise shaping (TNS)." Audio Engineering Society Convention 101. Audio Engineering Society, 1996.

[2] Herre, Jurgen, and James D. Johnston. "Continuously signal-adaptive filterbank for high-quality perceptual audio coding." Applications of Signal Processing to Audio and Acoustics, 1997. 1997 IEEE ASSP Workshop on. IEEE, 1997.

[3] Herre, Jurgen. "Temporal noise shaping, quantization and coding methods in perceptual audio coding: A tutorial introduction." Audio Engineering Society Conference: 17$^{th}$ International Conference: High-Quality Audio Coding. Audio Engineering Society, 1999.

[4] Herre, Juergen Heinrich. "Perceptual noise shaping in the time domain via LPC prediction in the frequency domain." U.S. Pat. No. 5,781,888. 14 Jul. 1998.

[5] Herre, Juergen Heinrich. "Enhanced joint stereo coding method using temporal envelope shaping." U.S. Pat. No. 5,812,971. 22 Sep. 1998.

[6] 3GPP TS 26.403; General audio codec audio processing functions; Enhanced aacPlus general audio codec; Encoder specification; Advanced Audio Coding (AAC) part.

[7] ISO/IEC 14496-3:2001; Information technology—Coding of audio-visual objects—Part 3: Audio.

[8] 3GPP TS 26.445; Codec for Enhanced Voice Services (EVS); Detailed algorithmic description.

Temporal Noise Shaping (TNS) is a tool for transform-based audio coders that was developed in the 90s (conference papers [1-3] and patents [4-5]). Since then, it has been integrated in major audio coding standards such as MPEG-2 AAC, MPEG-4 AAC, 3GPP E-AAC-Plus, MPEG-D USAC, 3GPP EVS, MPEG-H 3D Audio.

TNS can be briefly described as follows. At the encoder-side and before quantization, a signal is filtered in the frequency domain (FD) using linear prediction, LP, in order to flatten the signal in the time-domain. At the decoder-side and after inverse quantization, the signal is filtered back in the frequency-domain using the inverse prediction filter, in order to shape the quantization noise in the time-domain such that it is masked by the signal.

TNS is effective at reducing the so-called pre-echo artefact on signals containing sharp attacks such as e.g. castanets. It is also helpful for signals containing pseudo stationary series of impulse-like signals such as e.g. speech.

TNS is generally used in an audio coder operating at relatively high bitrate. When used in an audio coder operating at low bitrate, TNS can sometimes introduce artefacts, degrading the quality of the audio coder. These artefacts are click-like or noise-like and appear in most of the cases with speech signals or tonal music signals.

Examples in the present document permit to suppress or reduce the impairments of TNS maintaining its advantages.

Several examples below permit to obtain an improved TNS for low-bitrate audio coding.

SUMMARY

According to an embodiment, an encoder apparatus may have: a temporal noise shaping, TNS, tool for performing linear prediction, LP, filtering on an information signal including a plurality of frames; and a controller configured to control the TNS tool so that the TNS tool performs LP filtering with: a first filter whose impulse response has a higher energy; and a second filter whose impulse response has a lower energy, wherein the second filter is not an identity filter, wherein the controller is configured to choose between filtering with the first filter and filtering with the second filter on the basis of a frame metrics, wherein the controller is further configured to: modify the first filter so as to acquire the second filter in which the filter's impulse response energy is reduced.

According to another embodiment, a method for performing temporal noise shaping, TNS, filtering on an information signal including a plurality of frames may have the steps of: for each frame, choosing between filtering with a first filter and filtering with a second filter, whose impulse response has a lower energy, on the basis of a frame metrics, wherein the second filter is not an identity filter; filtering the frame using the filtering with the filtering chosen between filtering with the first filter and filtering with the second filter; and modify the first filter so as to acquire the second filter in which the filter's impulse response energy is reduced.

Another embodiment may have a non-transitory digital storage medium having a computer program stored thereon to perform the method for performing temporal noise shaping, TNS, filtering on an information signal including a plurality of frames, the method having the steps of: for each frame, choosing between filtering with a first filter and filtering with a second filter, whose impulse response has a lower energy, on the basis of a frame metrics, wherein the second filter is not an identity filter; filtering the frame using the filtering with the filtering chosen between filtering with the first filter and filtering with the second filter; and modify the first filter so as to acquire the second filter in which the filter's impulse response energy is reduced, when said computer program is run by a computer.

In accordance with examples, there is provided an encoder apparatus comprising:

- a temporal noise shaping, TNS, tool for performing linear prediction, LP, filtering on an information signal including a plurality of frames; and
- a controller configured to control the TNS tool so that the TNS tool performs LP filtering with:
  - a first filter whose impulse response has a higher energy; and
  - a second filter whose impulse response has a lower energy than the impulse response of the first filter, wherein the second filter is not an identity filter,
- wherein the controller is configured to choose between filtering with the first filter and filtering with the second filter on the basis of a frame metrics.

It has been noted that it is possible to remove artefacts on problematic frames while minimally affecting the other frames.

Instead of simply turning on/off the TNS operations, it is possible to maintain the advantages of the TNS tool while reducing its impairments. Therefore, an intelligent real-time feedback-based control is therefore obtained by simply reducing filtering where needed instead of avoiding it.

In accordance with examples, the controller is further configured to:

modify the first filter so as to obtain the second filter in which the filter's impulse response energy is reduced.

Accordingly, the second filter with reduced impulse response energy may be crated when needed.

In accordance with examples, the controller is further configured to:

apply at least one adjustment factor to the first filter to obtain the second filter.

By intelligently modifying the first filter, a filtering status may be created which is not be achievable by simply performing operations of turning on/off the TNS. At least one intermediate status between full filtering and no filtering is obtained. This intermediate status, if invoked when needed, permits to reduce the disadvantages of the TNS maintaining its positive characteristics.

In accordance with examples, the controller is further configured to:

define the at least one adjustment factor on the basis of at least the frame metrics.

In accordance with examples, the controller is further configured to:

define the at least one adjustment factor on the basis of a TNS filtering determination threshold which is used for selecting between performing TNS filtering and non-performing TNS filtering.

In accordance with examples, the controller is further configured to:

define the at least one adjustment factor using a linear function of the frame metrics, the linear function being such that an increase in the frame metrics corresponds to an increase of the adjustment factor and/or of the filter's impulse response energy.

Therefore, it is possible to define, for different metrics, different adjustment factors to obtain the filter parameters which are the most appropriated for each frame.

In accordance with examples, the controller is further configured to define the adjustment factor as $$\gamma = \begin{cases} 1 - (1 - \gamma_{min})\dfrac{\text{thresh2} - \mathit{frameMetrics}}{\text{thresh2} - \text{thresh}}, & \text{if } \mathit{frameMetrics} < \text{thresh2} \\ 1, & \text{otherwise} \end{cases}$$

wherein thresh is the TNS filtering determination threshold, thresh2 is the filtering type determination threshold, frameMetrics is a frame metrics, and $\gamma_{min}$ is a fixed value.

Artefacts caused by the TNS occur in frames in which the prediction gain is in a particular interval, which is here defined as the set of values higher than the TNS filtering determination threshold thresh but lower than the filtering determination threshold thresh2. In some cases in which the metrics is the prediction gain, thresh=1.5 and thresh2=2, artefacts caused by the TNS tend to occur between 1.5 and 2. Therefore, several examples permit to overcome these impairments by reducing the filtering for 1.5<predGain<2.

In accordance with examples, the controller is further configured to modify the parameters of the first filter to obtain the parameters of the second filter by applying:

$$\alpha_w(k) = \gamma^k \alpha(k), k = 0, \ldots, K$$

where $\alpha(k)$ are parameters of the first filter, $\gamma$ is the adjustment factor such that $0<\gamma<1$, $\alpha_w(k)$ are the parameters of the second filter and K is the order of the first filter.

This is an easy but valid technique for obtaining the parameters of the second filter so that the impulse response energy is reduced in respect to the impulse response energy of the first filter.

In accordance with examples, the controller is further configured to obtain the frame metrics from at least one of a prediction gain, an energy of the information signal and/or a prediction error.

That these metrics permit to easily and reliably discriminate the frames which need to be filtered by the second filter from the frames which need to be filtered by the first filter.

In accordance with examples, the frame metrics comprises a prediction gain calculated as $$predGain = \frac{\text{energy}}{predError}$$

where energy is a term associated to an energy of the information signal, and predError is a term associated to a prediction error.

In accordance with examples, the controller is configured so that:

at least for a reduction of a prediction gain and/or a reduction of an energy of the information signal, the second filter's impulse response energy is reduced, and/or at least for an increase of the prediction error, the second filter's impulse response energy is reduced.

In accordance with examples, the controller is configured to:

compare the frame metrics with a filtering type determination threshold (e.g., thresh2), so as to perform a filtering with the first filter when the frame metrics is lower than the filtering type determination threshold.

Accordingly, it is easy to automatically establish whether the signal is to be filtered using the first filter or using the second filter.

In accordance with examples, the controller is configured to:

choose between performing a filtering and non-performing filtering on the basis of the frame metrics.

Accordingly, it is also possible to completely avoid TNS filtering at all when not appropriated.

In examples, the same metrics may be used twice (by performing comparisons with two different thresholds): both for deciding between the first filter and second filter, and for deciding whether to filter or not to filter.

In accordance with examples, the controller is configured to:

compare the frame metrics with a TNS filtering determination threshold, so as to choose to avoid TNS filtering when the frame metrics is lower than the TNS filtering determination threshold.

In accordance with examples, the apparatus may further comprise:

a bitstream writer to prepare a bitstream with reflection coefficients, or a quantized version thereof, obtained by the TNS.

These data may be stored and/or transmitted, for example, to a decoder.

In accordance with examples, there is provided a system comprising an encoder side and a decoder side, wherein the encoder side comprises an encoder apparatus as above and/or below.

In accordance with examples, there is provided a method for performing temporal noise shaping, TNS, filtering on an information signal including a plurality of frames, the method comprising:

for each frame, choosing, on the basis of a frame metrics, between filtering with a first filter whose impulse response has a higher energy and filtering with a second filter whose impulse response has an energy lower than the energy of the impulse response of the first filter (14*a*), wherein the second filter is not an identity filter;

filtering the frame using the filtering with the chosen between the first filter and the second filter.

In accordance with examples, there is provided a non-transitory storage device storing instructions which, when executed by a processor, cause the processor to perform at least some of the steps of the methods above and/or below and/or to implement a system as above or below and/or an apparatus as above and/or below.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
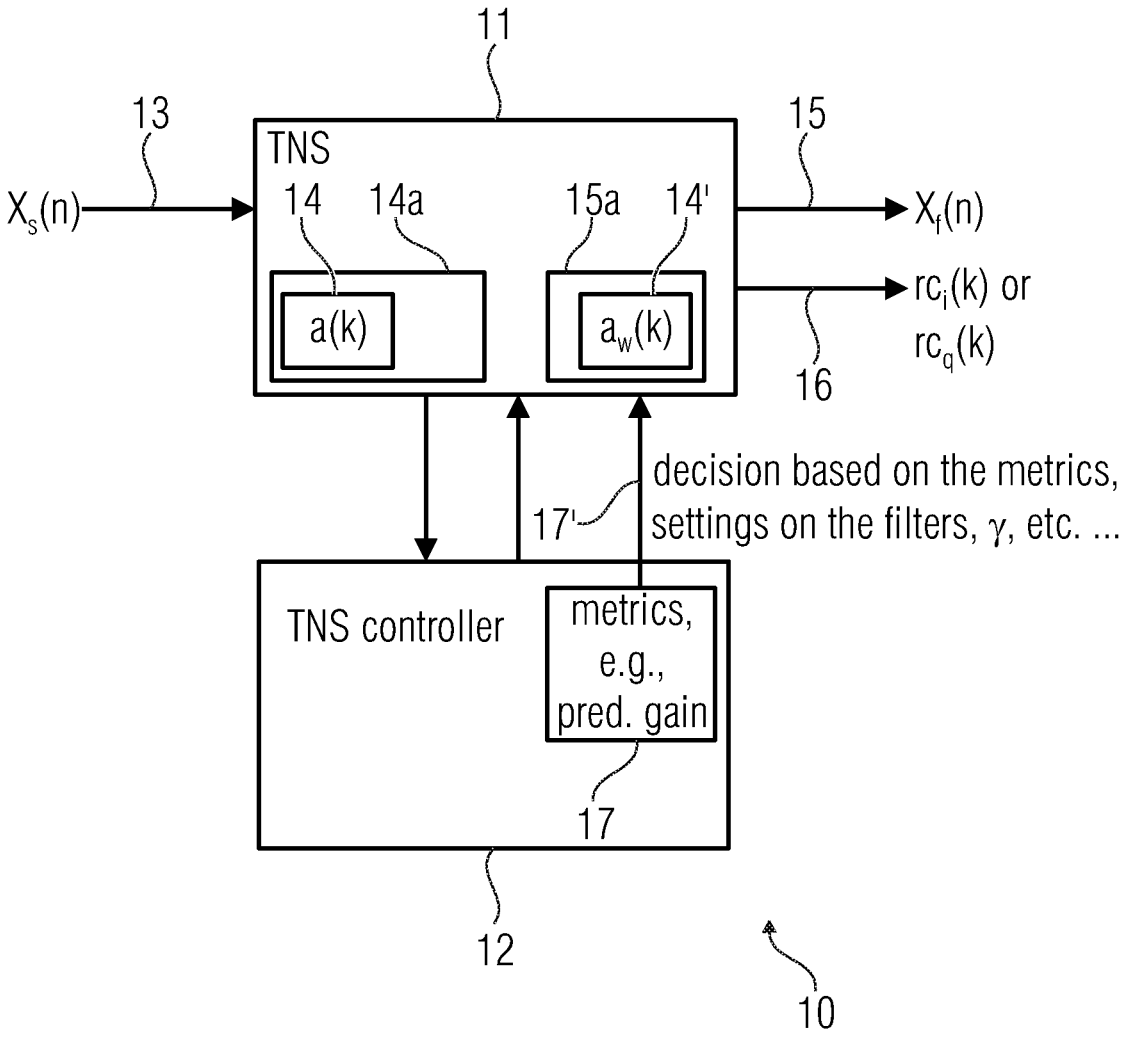
FIG. 1 shows an encoder apparatus according to an example.

FIG. 1 shows an encoder apparatus 10. The encoder apparatus 10 may be for processing (and transmitting and/or storing) information signals, such as audio signals. An information signal may be divided into a temporal succession of frames. Each frame may be represented, for example, in the frequency domain, FD. The FD representation may be a succession of bins, each at a specific frequency. The FD representation may be a frequency spectrum.

The encoder apparatus 10 may, inter alia, comprise a temporal noise shaping, TNS, tool 11 for performing TNS filtering on an FD information signal 13 (Xs(n)). The encoder apparatus 10 may, inter alia, comprise a TNS controller 12. The TNS controller 12 may be configured to control the TNS tool 11 so that the TNS tool 11 performs filtering (e.g., for some frames) using at least one higher impulse response energy linear prediction (LP) filtering and (e.g., for some other frames) using at least one higher impulse response energy LP filtering. The TNS controller 12 is configured to perform a selection between higher impulse response energy LP filtering and lower impulse response energy LP filtering on the basis of a metrics associated to the frame (frame metrics). The energy of the impulse response of the first filter is higher than the energy of the impulse response of the second filter.

The FD information signal 13 ($X_s(n)$) may be, for example, obtained from a modified discrete cosine transform, MDCT, tool (or modified discrete sine transform MDST, for example) which has transformed a representation of a frame from a time domain, TD, to the frequency domain, FD.

The TNS tool 11 may process signals, for example, using a group of linear prediction (LP) filter parameters 14 (a(k)), which may be parameters of a first filter 14*a*. The TNS tool 11 may also comprise parameters 14' ($a_w(k)$) which may be parameters of a second filter 15*a* (the second filter 15*a* may have an impulse response with lower energy as compared to the impulse response of the first filter 14*a*). The parameters 14' may be understood as a weighted version of the parameters 14, and the second filter 15*a* may be understood as being derived from the first filter 14*a*. Parameters may comprise, inter alia, one or more of the following parameters (or the quantized version thereof): LP coding, LPC, coefficients, reflection coefficients, RCs, coefficients $rc_i(k)$ or quantized versions thereof $rc_q(k)$, arcsine reflection coefficients, ASRCs, log-area ratios, LARs, line spectral pairs, LSPs, and/or line spectral frequencies, LS, or other kinds of such parameters. In examples, it is possible to use any representation of filter coefficients.

The output of the TNS tool 11 may be a filtered version 15 ($X_f(n)$) of the FD information signal 13 ($X_s(n)$).

Another output of the TNS tool 11 may be a group of output parameters 16, such as reflection coefficients $rc_i(k)$ (or quantized versions thereof $rc_q(k)$).

Downstream to the components 11 and 12, a bitstream coder may encode the outputs 15 and 16 into a bitstream which may be transmitted (e.g., wirelessly, e.g., using a protocol such as Bluetooth) and/or stored (e.g., in a mass memory storage unit).

TNS filtering provides reflection coefficients which are in general different from zero. TNS filtering provides an output which is in general different from the input.

Figure 2:
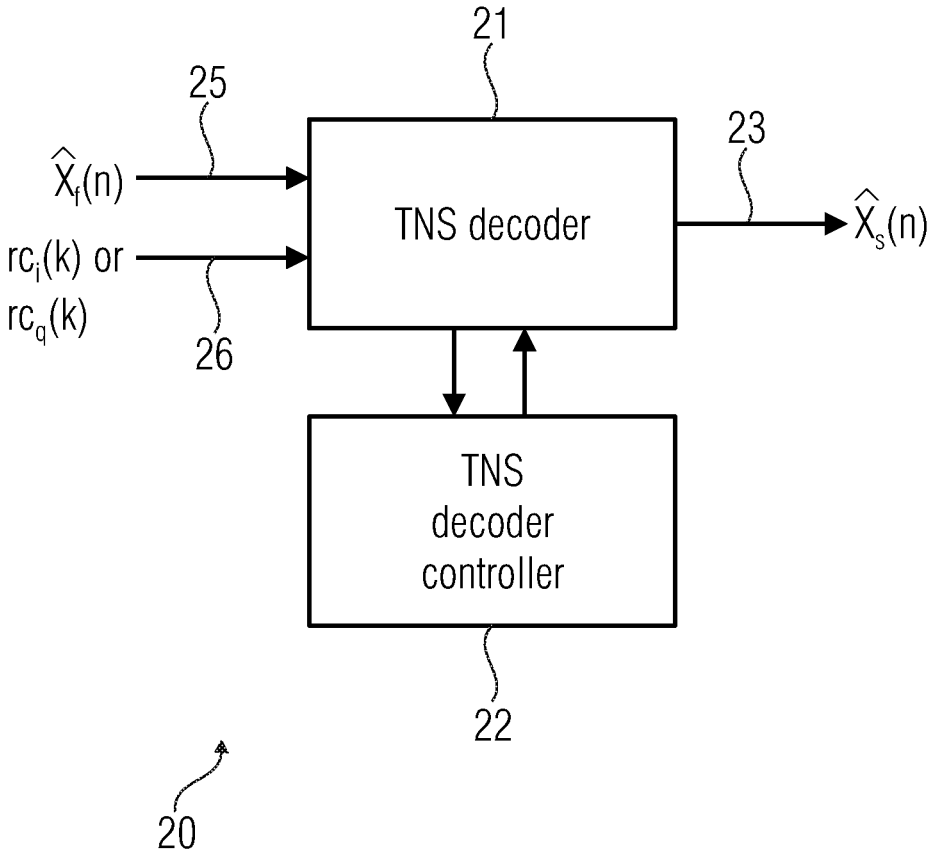
FIG. 2 shows a decoder apparatus according to an example.

FIG. 2 shows a decoder apparatus 20 which may make use of the output (or a processed version thereof) of the TNS tool 11. The decoder apparatus 20 may comprise, inter alia, a TNS decoder 21 and a TNS decoder controller 22. The components 21 and 22 may cooperate to obtain a synthesis output 23 ($\hat{X}_s(n)$). The TNS decoder 21 may be, for example, input with a decoded representation 25 (or a processed version thereof ($\hat{X}_f(n)$) of the information signal as obtained by the decoder apparatus 20. The TNS decoder 21 may obtain in input (as input 26) reflection coefficients $rc_i(k)$ (or quantized versions thereof $rc_q(k)$). The reflection coefficients $rc_i(k)$ or $rc_q(k)$ may be the decoded version of the reflection coefficients $rc_i(k)$ or $rc_q(k)$ provided at output 16 by the encoder apparatus 10.

As shown in FIG. 1, the TNS controller 12 may control the TNS tool 11 on the basis, inter alia, of a frame metrics 17 (e.g., prediction gain or predGain). For example, the TNS controller 12 may perform filtering by choosing between at least a higher impulse response energy LP filtering and/or a lower impulse response energy LP filtering, and/or between filtering and non-filtering. Apart from the higher impulse response energy LP filtering and the lower impulse response energy LP filtering, at least one intermediate impulse response energy LP filtering are possible according to examples.

Reference numeral 17' in FIG. 1 refers to information, commands and/or control data which are provided to the TNS tool 14 from the TNS controller 12. For example, a decision based on the metrics 17 (e.g., "use the first filter" or "use the second filter") may be provided to the TNS tool 14. Settings on the filters may also be provided to the TNS tool 14. For example, an adjustment factor (γ) may be provided to the TNS filter so as to modify the first filter 14*a* to obtain the second filter 15*a*.

The metrics 17 may be, for example, a metrics associated to the energy of the signal in the frame (for example, the metrics may be such that the higher the energy, the higher the metrics). The metrics may be, for example, a metrics associated to a prediction error (for example, the metrics may be such that the higher the prediction error, the lower the metric). The metrics may be, for example, a value associated to the relationship between the prediction error and energy of the signal (for example, the metrics may be such that the higher the ratio between the energy and the prediction error, the higher the metrics). The metrics may be, for example, a prediction gain for a current frame, or a value associated or proportional to the prediction gain for the current frame (such as, for example, the higher the prediction gain, the higher the metrics). The frame metrics (17) may be associated to the flatness of the signal's temporal envelope.

It has been noted that artefacts due to TNS occur only (or at least prevalently) when the prediction gain is low. Therefore, when the prediction gain is high, the problems caused by TNS do not arise (or are less prone to arise) and it is possible to perform full TNS (e.g., higher impulse response energy LP). When the prediction gain is very low, it is advantageous not to perform TNS at all (non-filtering). When the prediction gain is intermediate, it is advantageous to reduce the effects of the TNS by using a lower impulse response energy linear prediction filtering (e.g., by weighting LP coefficients or other filtering parameters and/or reflection coefficients and/or using a filter whose impulse response has a lower energy). The higher impulse response energy LP filtering and the lower impulse response energy LP filtering are different from each other in that the higher impulse response energy LP filtering is defined so as to cause a higher impulse response energy than the lower impulse response energy LP filtering. A filter is in general characterized by the impulse response energy and, therefore, it is possible to identify it with its impulse response energy. The higher impulse response energy LP filtering means using a filter whose impulse response has a higher energy than the filter used in the lower impulse response energy LP filtering.

Hence, with the present examples, the TNS operations may be computed by:

- performing high impulse response energy LP filtering when the metrics (e.g. prediction gain) is high (e.g., over a filtering type determination threshold);
- performing low impulse response energy LP filtering when the metrics (e.g. prediction gain) is intermediate (e.g., between a TNS filtering determination threshold and the filtering type determination threshold); and
- non-performing TNS filtering when the metrics (e.g. prediction gain) is low (e.g., under the TNS filtering determination threshold).

High impulse response energy LP filtering may be obtained, for example, using a first filter having a high impulse response energy. Low impulse response energy LP filtering may be obtained, for example, using a second filter having a lower impulse response energy. The first and second filter may be linear time-invariant (LTI) filters.

In examples, the first filter may be described using the filter parameters a(k) (14). In examples, the second filter may be a modified version of the first filter (e.g., as obtained by the TNS controller 12). The second filter (lower impulse response energy filter) may be obtained by downscaling the filter parameters of the first filter (e.g., using a parameter γ or $\gamma^k$ such that $0<\gamma^k$ such that $0<\gamma<1$, with k being a natural number such that $k \leq K$, K being the order of the first filter).

Therefore, in examples, when the filter parameters are obtained, and on the basis of the metrics, it is determined that the lower impulse response energy filtering may be used, the filter parameters of the first filter may be modified (e.g., downscaled) to obtain filter parameters of the second filter, to be used for the lower impulse selection energy filter.

Figure 10:
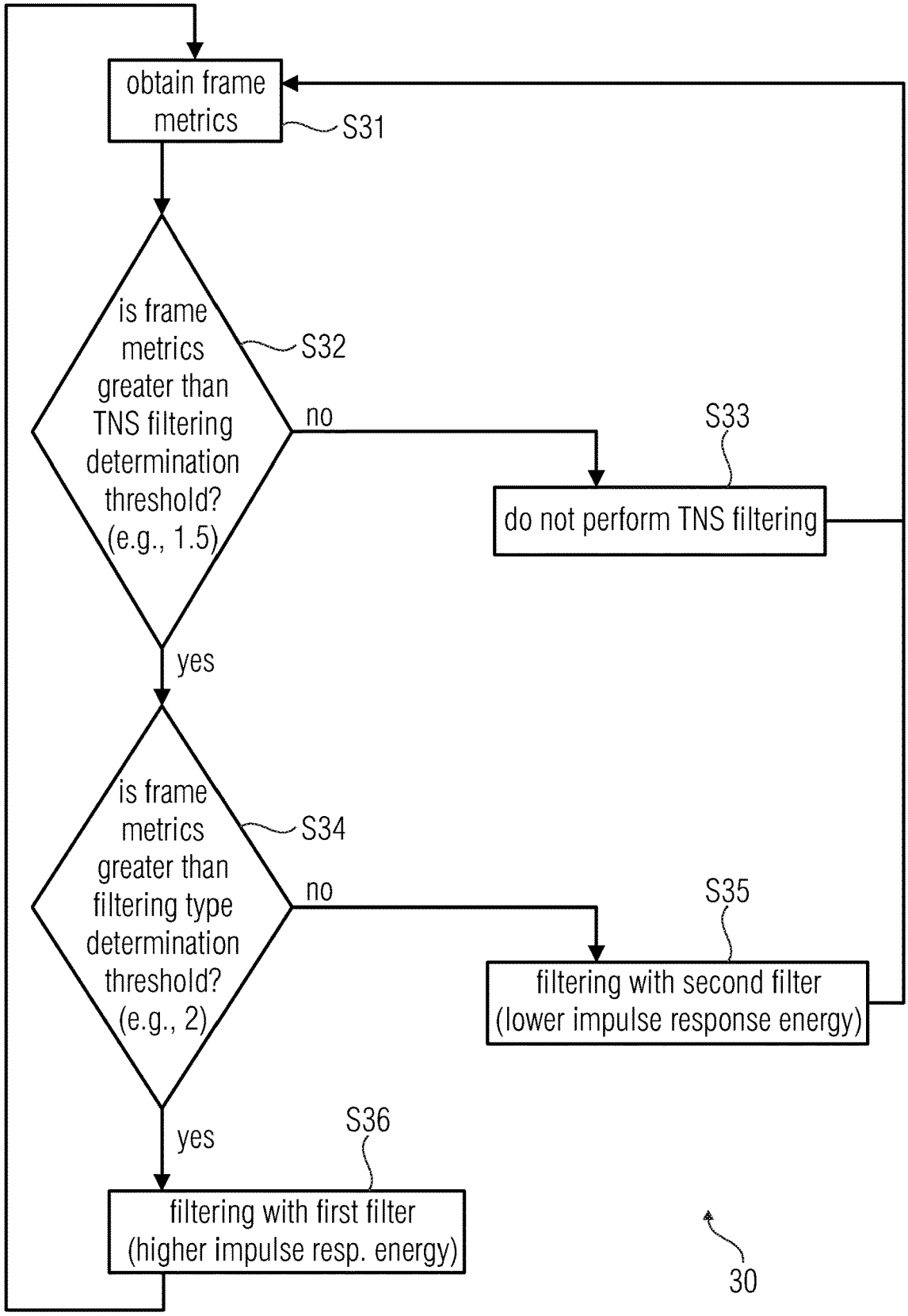
FIG. 10 shows a method according to an example.

FIG. 10 shows a method 30 which may be implemented at the encoder apparatus 10.

At step S31, a frame metrics (e.g., prediction gain 17) is obtained.

At step S32, it is checked whether the frame metrics 17 is higher than a TNS filtering determination threshold or first threshold (which may be 1.5, in some examples). An example of metrics may be a prediction gain.

If at S32 it is verified that the frame metrics 17 is lower than the first threshold (thresh), no filtering operation is performed at S33 (it could be possible to say that an identity filter is used, the identity filter being a filter in which the output is the same of the input). For example, $X_f(n)=X_s(n)$ (the output 15 of the TNS tool 11 is the same as the input 13), and/or the reflection coefficients $rc_i(k)$ (and/or their quantized versions $rc_0(k)$) are also set at 0. Therefore, the operations (and the output) of the decoder apparatus 20 will not be influenced by the TNS tool 11. Hence, at S33, neither the first filter nor the second filter may be used.

If at S32 it is verified that the frame metrics 17 is greater than the TNS filtering determination threshold or first threshold (thresh), a second check may be performed at step S34 by comparing the frame metrics with a filtering type determination threshold or second threshold (thresh2, which may be greater than the first threshold, and be, for example, 2).

If at S34 it is verified that the frame metrics 17 is lower than the filtering type determination threshold or second threshold (thresh2), lower impulse response energy LP filtering is performed at S35 (e.g., a second filter with lower impulse response energy is used, the second filter non-being an identity filter).

If at S34 it is verified that the frame metrics 17 is greater than the filtering type determination threshold or second threshold (thresh2), higher impulse response energy LP filtering is performed at S36 (e.g., a first filter whose response energy is higher than the lower energy filter is used).

The method 30 may be reiterated for a subsequent frame.

In examples, the lower impulse response energy LP filtering (S35) may differ from the higher impulse response energy LP filtering (S36) in that the filter parameters 14 (a(k)) may be weighted, for example, by different values (e.g., the higher impulse response energy LP filtering may be based on unitary weights and the lower impulse response energy LP filtering may be based on weights lower than 1). In examples, the lower impulse response energy LP filtering may differ from the higher impulse response energy LP filtering in that the reflection coefficients 16 obtained by performing lower impulse response energy LP filtering may cause a higher reduction of the impulse response energy than the reduction caused by the reflection coefficients obtained by performing higher impulse response energy LP filtering.

Hence, while performing higher impulse response energy filtering at the step S36, the first filter is used on the basis of the filter parameters 14 (a(k)) (which are therefore the first filter parameters). While performing lower impulse response energy filtering at the step S35, the second filter is used. The second filter may be obtained by modifying the parameters of the first filter (e.g., by weighting with weight less than 1).

The sequence of steps S31-S32-S34 may be different in other examples: for example, S34 may precede S32. One of the steps S32 and/or S34 may be optional in some examples.

In examples, at least one of the first and/or second thresholds may be fixed (e.g., stored in a memory element).

In examples, the lower impulse response energy filtering may be obtained by reducing the impulse response of the filter by adjusting the LP filter parameters (e.g., LPC coefficients or other filtering parameters) and/or the reflection coefficients, or an intermediate value used to obtain the reflection coefficients. For example, coefficients less than 1 (weights) may be applied to the LP filter parameters (e.g., LPC coefficients or other filtering parameters) and/or the reflection coefficients, or an intermediate value used to obtain the reflection coefficients.

In examples, the adjustment (and/or the reduction of the impulse response energy) may be (or be in terms of):

$$\gamma = \begin{cases} 1-(1-\gamma_{min})\dfrac{\text{thresh2}-\textit{frameMetrics}}{\text{thresh2}-\text{thresh}}, & \text{if } \textit{frameMetrics} < \text{thresh2} \\ 1, & \text{otherwise} \end{cases}$$

where thresh2 is the filtering type determination threshold (and may be, for example, 2), thresh is the TNS filtering determination threshold (and may be 1.5), $\gamma_{min}$ is a constant (e.g., a value between 0.7 and 0.95, such as between 0.8 and 0.9, such as 0.85). γ values may be used to scale the LPC coefficients (or other filtering parameters) and/or the reflection coefficients. frameMetrics is the frame metrics.

In one example, the formula may be $$\gamma = \begin{cases} 1-(1-\gamma_{min})\dfrac{\text{thresh2}-\textit{predGain}}{\text{thresh2}-\text{thresh}}, & \text{if } \textit{predGain} < \text{thresh2} \\ 1, & \text{otherwise} \end{cases}$$

where thresh2 is the filtering type determination threshold (and may be, for example, 2), thresh is the TNS filtering determination threshold (and may be 1.5), $\gamma_{min}$ is a constant (e.g., a value between 0.7 and 0.95, such as between 0.8 and 0.9, such as 0.85). γ values may be used to scale the LPC coefficients (or other filtering parameters) and/or the reflection coefficients. predGain may be the prediction gain, for example.

From the formula it may be seen that a frameMetrics (or predGain) lower than thresh2 but close to it (e.g., 1.999) will cause the reduction of impulse response energy to be weak (e.g. γ≅1). Therefore, the lower impulse response energy LP filtering may be one of a plurality of different lower impulse response energy LP filterings, each being characterized by a different adjustment parameter γ, e.g., in accordance to the value of the frame metrics.

In examples of lower impulse response energy LP filtering, different values of the metrics may cause different adjustments. For example, a higher prediction gain may be associated to a higher a higher value of γ, and a lower reduction of the impulse response energy with respect to the first filter. γ may be seen as a linear function dependent from predGain. An increment of predGain will cause an increment of γ, which in turn will diminish the reduction of the impulse response energy. If predGain is reduced, γ is also reduced, and the impulse response energy will be accordingly also reduced.

Therefore, subsequent frames of the same signal may be differently filtered:

- some frames may be filtered using the first filter (higher impulse response energy filtering), in which the filter parameters (14) are maintained;
- some other frames may be filtered using the second filter (lower impulse response energy filtering), in which the first filter is modified to obtain a second filter with lower impulse response energy (the filter parameters 14 being modified, for example) to reduce the impulse response energy 'with respect to the first filter;
- some other frames may also be filtered using the second filter (lower impulse response energy filtering), but with different adjustment (as a consequence of a different values of the frame metrics).

Accordingly, for each frame, a particular first filter may be defined (e.g., on the basis of the filter parameters), while a second filter may be developed by modifying the filter parameters of the first filter.

Figure 3A:
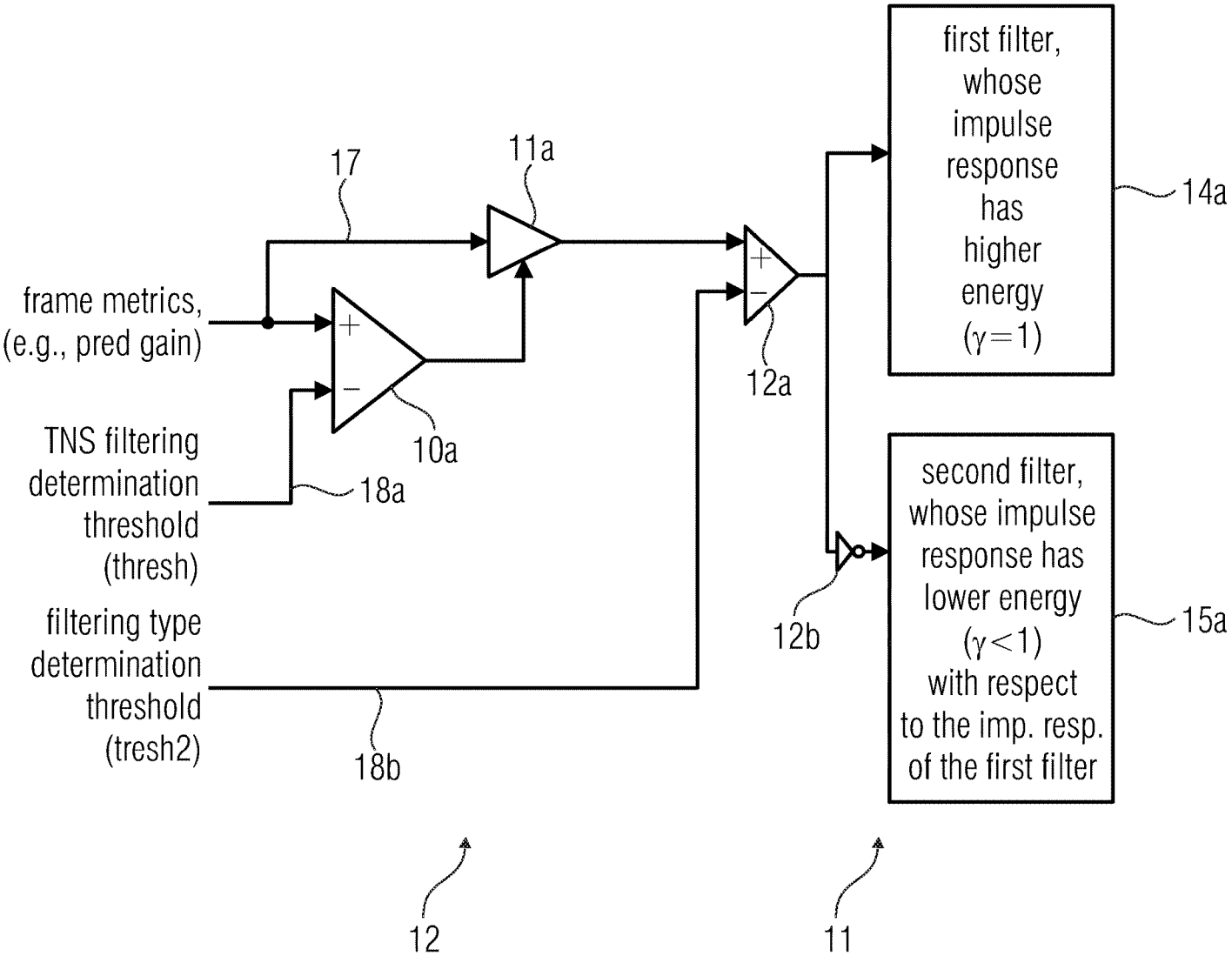
FIG. 3A shows a technique according to an example.

FIG. 3A shows an example of the controller 12 and the TNS block 11 cooperating to perform TNS filtering operations.

A frame metrics (e.g., prediction gain) 17 may be obtained and compared to a TNS filtering determination threshold 18*a* (e.g., at a comparer 10*a*). If the frame metrics 17 is greater than the TNS filtering determination threshold 18*a* (thresh), it is permitted (e.g., by the selector 11*a*) to compare the frame metrics 17 with a filtering type determination threshold 18*b* (e.g., at a comparer 12*a*). If the frame metrics 17 is greater than the filtering type determination threshold 18*b*, then a first filter 14*a* whose impulse response has higher energy (e.g. γ=1) is activated. If the frame metrics 17 is lower than the filtering type determination threshold 18*b*, then a second filter 15*a* whose impulse response has lower energy (e.g., γ<1) is activated (element 12*b* indicates a negation of the binary value output by the comparer 12*a*). The first filter 14*a* whose impulse response has higher energy may perform filtering S36 with higher impulse response energy, and the second filter 15*a* whose impulse response has lower energy may perform filtering S35 with lower impulse response energy.

Figure 3B:
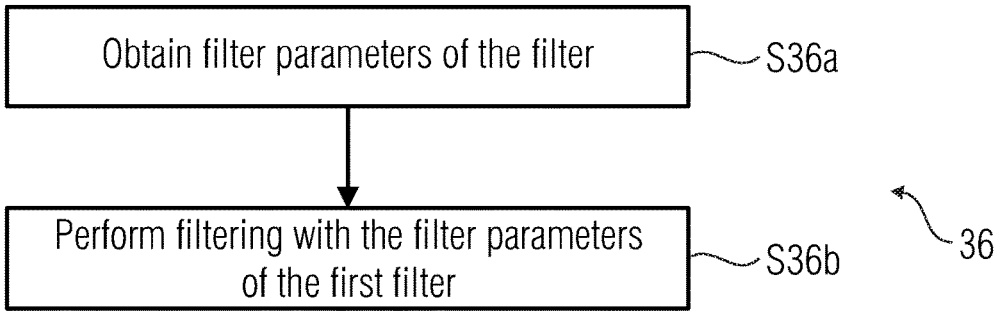
FIGS. 3B and 3C show methods according to examples.
Figure 3C:
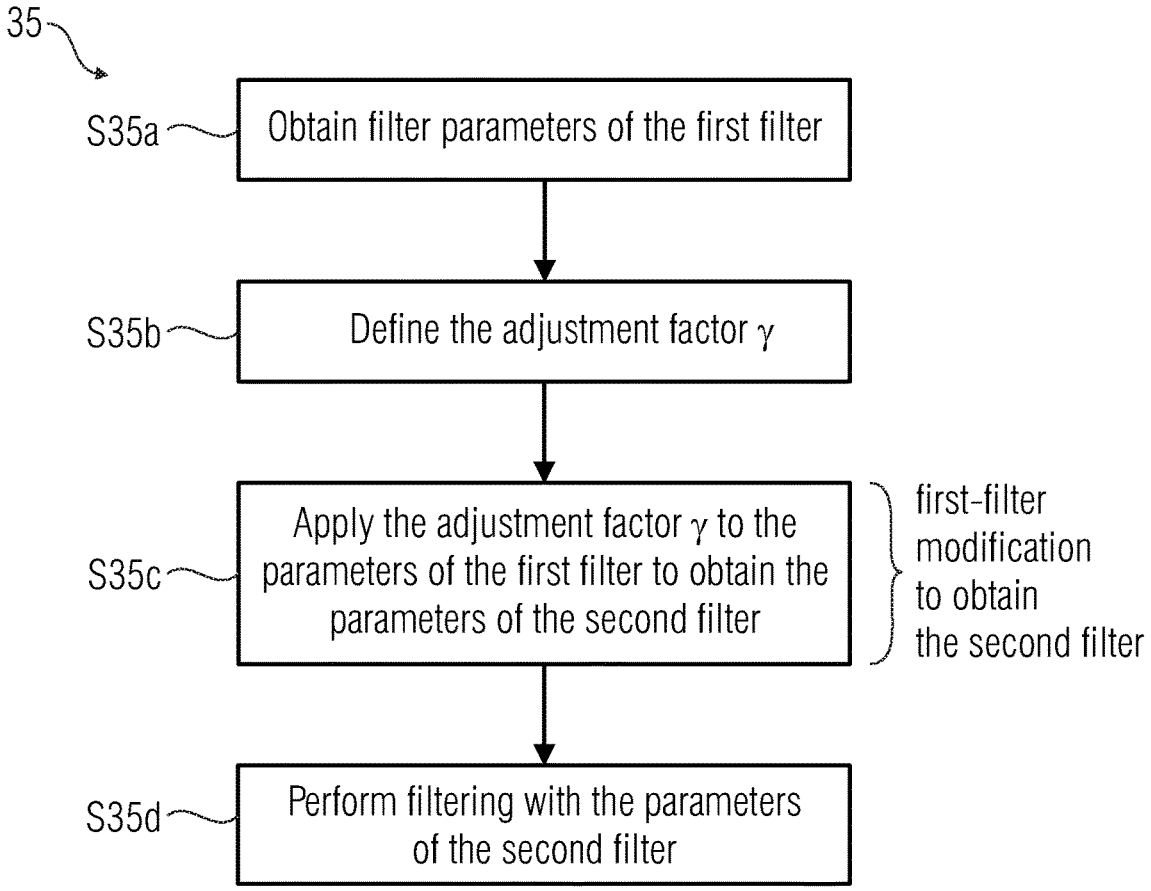

FIGS. 3B and 3C shows methods 36 and 35 for using the first and the second filters 14*a* and 15*a*, respectively (e.g., for steps S36 and S35, respectively).

The method 36 may comprise a step S36*a* of obtaining the filter parameters 14. The method 36 may comprise a step S36*b* performing filtering (e.g., S36) using the parameters of the first filter 14*a*. Step S35*b* may be performed only at the determination (e.g., at step S34) that the frame metrics is over the filtering type determination threshold (e.g., at step S35).

The method 35 may comprise a step S35*a* of obtaining the filter parameters 14 of the first filter 14*a*. The method 35 may comprise a step S35*b* of defining the adjustment factor γ (e.g., by using at least one of the thresholds thresh and thresh2 and the frame metrics). The method 35 may comprise a step 35*c* for modifying the first filter 14*a* to obtain a second filter 15*a* having lower impulse response energy with respect to the first filter 14*a*. In particular, the first filter 14*a* may be modified by applying the adjustment factor γ (e.g., as obtained at S35*b*) to the parameters 14 of the first filter 14*a*, to obtain the parameters of the second filter. The method 35 may comprise a step S35*d* in which the filtering with the second filter (e.g., at S35 of the method 30) is performed. Steps S35*a*, S35*b*, and S35*c* may be performed at the determination (e.g., at step S34) that the frame metrics is less than the filtering type determination threshold (e.g., at step S35).

Figure 4:
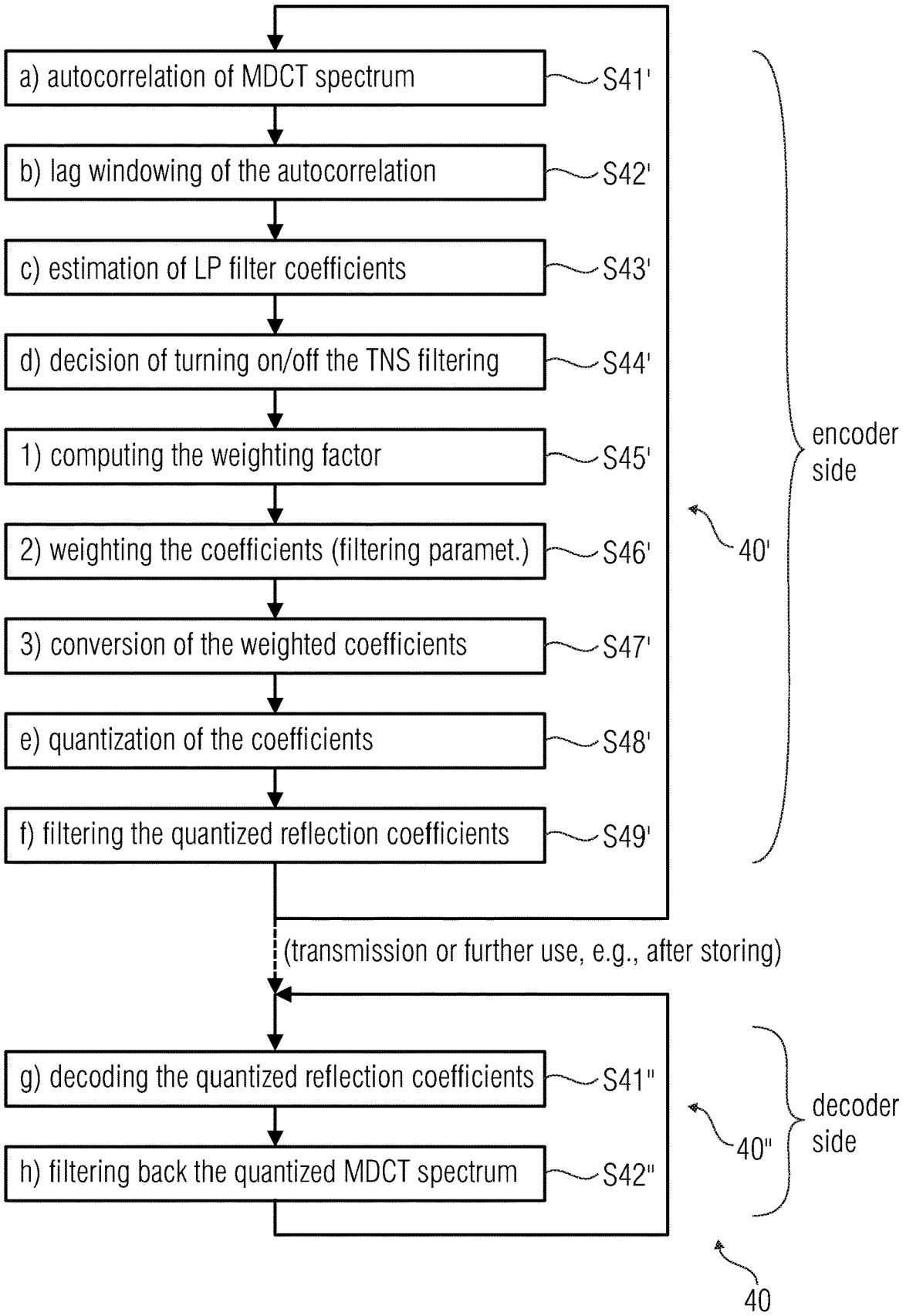
FIG. 4 shows methods according to examples.

FIG. 4 shows a method 40' (encoder side) and a method 40" (decoder side) which may form a single method 40. The methods 40' and 40" may have some contact in that a decoder operating according to the method 40' may transmit a bitstream (e.g., wirelessly, e.g., using Bluetooth) to a decoder operating according to the method 40".

The steps of method 40 (indicated as a sequence a)-b)-c)-d)-1)-2)-3)-e-f) and by the sequence S41'-S49') is discussed here below.

a) Step S41': The autocorrelation of the MDCT (or MDST) spectrum (FD value) may be processed, for example, $$r(k) = \sum_{n=n_{start}}^{n_{stop}-k} c(n)c(n+k),\ k = 0, \ldots, K$$

where K is the LP filter order (e.g. K=8). Here, c(n) may be the FD value input to the TNS tool 11. For example, c(n) may refer to a bin associated to a frequency with index n.

b) Step S42': The autocorrelation may be lag windowed:

$$r(k)=r(k)w(k),\ k=0, \ldots, K$$

An example of lag windowing function may be, for example:

$$w(k)=\exp[-\tfrac{1}{2}(2\pi\alpha k)^2],\ k=0, \ldots, K$$

where α is a window parameter (e.g. a=0.011).

c) Step S43': LP filter coefficients may be estimated, using e.g. a Levinson-Durbin recursion procedure, such as:

$$e(0) = r(0)$$
$$a^0(0) = 1$$
$$\text{for } k = 1 \text{ to } K \text{ do}$$
$$rc(k) = \frac{-\sum_{n=0}^{k-1} a^{k-1}(n)r(k-n)}{e(k-1)}$$
$$a^k(k) = rc(k)$$
$$a^k(0) = 1$$
$$\text{for } n = 1 \text{ to } k-1 \text{ do}$$
$$a^k(n) = a^{k-1}(n) + rc(k)a^{k-1}(k-n)$$
$$e(k) = (1 - rc(k)^2)e(k-1)$$

where $\alpha(k)=\alpha^K(k)$, k=0, . . . , K are the estimated LPC coefficients (or other filtering parameters), rc(k), k=1, . . . , K are the corresponding reflection coefficients and e=e(K) is the prediction error.

d) Step S44': The decision (step S44' or S32) to turn on/off TNS filtering in the current frame may be based on e.g. a frame metrics, such as the prediction gain:

If predGain>thresh, then turn on TNS filtering where the prediction gain is computed by $$predGain = \frac{r(0)}{e}$$

and thresh is a threshold (e.g. thresh=1.5).

1) Step S45': The weighting factor γ may be obtained (e.g., at step S45') by $$\gamma = \begin{cases} 1 - (1 - \gamma_{min})\dfrac{\text{thresh2} - predGain}{\text{thresh2} - \text{thresh}}, & \text{if } predGain < \text{thresh2} \\ 1, & \text{otherwise} \end{cases}$$

where thresh2 is a second threshold (e.g. thresh2=2) and $\gamma_{min}$ is the minimum weighting factor (e.g. $\gamma_{min}$=0.85). The thresh2 may be, for example, the filtering type determination threshold.

When γ=1, the first filter 14*a* is used. When 0<γ<1, the second filter 15*a* is used (e.g., at step S35*b*).

2) Step S46': The LPC coefficients (or other filtering parameters) may be weighted (e.g., at step S46') using the factor γ:

$$\alpha_w(k)=\gamma^k\alpha(k),\ k=0, \ldots, K$$

$\gamma^k$ is an exponentiation (e.g., $\gamma^2=\gamma*\gamma$).

3) Step S47': The weighted LPC coefficients (or other filtering parameters) may be converted to reflection coefficients using, e.g., the following procedure (step S47'):

$$a^K(k) = a_w(k),\ k = 0, \ldots, K \text{ for}$$
$$k = K \text{ to } 1 \text{ do}$$
$$rc(k) = a^k(k)$$
$$e = (1 - rc(k)^2) \text{ for}$$
$$n = 1 \text{ to } k-1 \text{ do}$$
$$a^{k-1}(n) = \frac{a^k(n) - rc(k)a^k(k-n)}{e}$$

e) Step S48':If TNS is on (as a result of the determination of at S32, for example), the reflection coefficients may be quantized (step S48') using, e.g., scalar uniform quantization in the arcsine domain:

$$rc_i(k) = \text{round}\left[\frac{\arcsin(rc(k))}{\Delta}\right]$$
$$rc_q(k) = \sin(\Delta rc_i(k))$$

where Δ is the cell width $$\left(\text{e.g. } \Delta = \frac{\pi}{17}\right)$$

and round(.) is the rounding-to-nearest-integer function.

$rc_i(k)$ are the quantizer output indices which are then encoded using e.g. arithmetic encoding.

$rc_q(k)$ are the quantized reflection coefficients.

f) Step S49': If TNS is on, the MDCT (or MDST) spectrum is filtered (step S49') using the quantized reflection coefficients and a lattice filter structure $$s^0(n_{start}-1)=s^1(n_{start}-1)=\ldots=s^{K-1}(n_{start}-1)=0$$

for $n=n_{start}$ to $n_{stop}$ do
  $t^0(n)=s^0(n)=c(n)$
  for k=1 to K do
    $t^k(n)=t^{k-1}(n)+rc_q(k)s^{k-1}(n-1)$
    $s^k(n)=rc_q(k)t^{k-1}(n)+s^{k-1}(n-1)$
  $c_f(n)=t^K(n)$ A bitstream may be transmitted to the decoder. The bitstream may comprise, together with an FD representation of the information signal (e.g., an audio signal), also control data, such as the reflection coefficients obtained by performing TNS operations described above (TNS analysis).

Figure 5:
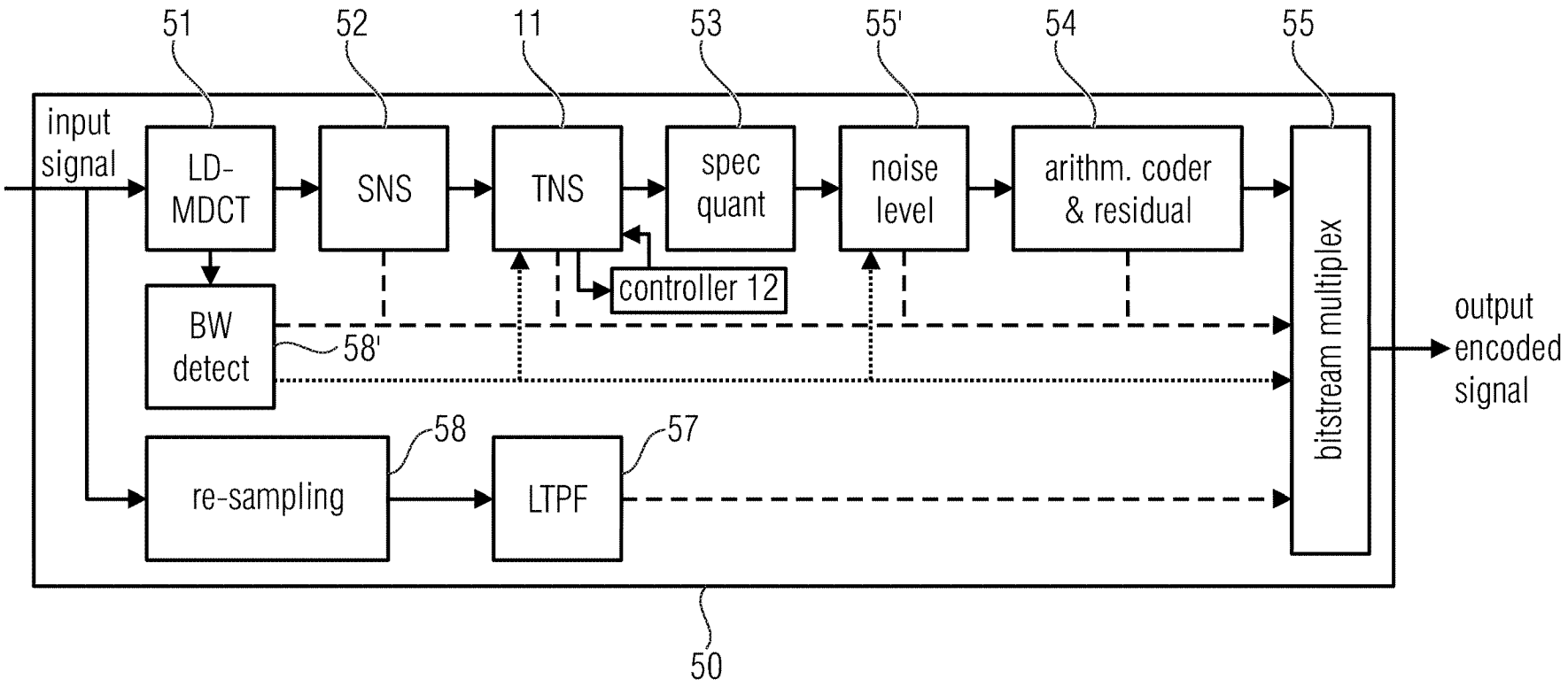
FIG. 5 shows an encoder apparatus according to an example.

The method 40" (decoder side) may comprise steps g) (S41") and h) (S42") in which, if TNS is on, the quantized reflection coefficients are decoded and the quantized MDCT (or MDST) spectrum is filtered back. The following procedure may be used:

$$s^0(n_{start}-1)=s^1(n_{start}-1)=\ldots=s^{K-1}(n_{start}-1)=0$$

for $n=n_{start}$ to $n_{stop}$ do
  $t^K(n)=c(n)$
  for k=K to 1 do
    $t^{k-1}(n)=t^k(n)-rc_q(k)s^{k-1}(n-1)$
    $s^k(n)=rc_q(k)t^{k-1}(n)+s^{k-1}(n-1)$
  $c_f(n)=s^0(n)=t^0(n)$ An example of encoder apparatus 50 (which may embody the encoder apparatus 10 and/or perform at least some of the operation of the methods 30 and 40') is shown in FIG. 5.

The encoder apparatus 50 may comprise a plurality of tools for encoding an input signal (which may be, for example, an audio signal). For example, a MDCT tool 51 may transform a TD representation of an information signal to an FD representation. A spectral noise shaper, SNS, tool 52 may perform noise shaping analysis (e.g., a spectral noise shaping, SNS, analysis), for example, and retrieve LPC coefficients or other filtering parameters (e.g., a(k), 14). The TNS tool 11 may be as above and may be controlled by the controller 12. The TNS tool 11 may perform a filtering operation (e.g. according to method 30 or 40') and output both a filtered version of the information signal and a version of the reflection coefficients. A quantizer tool 53 may perform a quantization of data output by the TNS tool 11. An arithmetic coder 54 may provide, for example, entropy coding. A noise level tool 55' may also be used for estimating a noise level of the signal. A bitstream writer 55 may generate a bitstream associated to the input signal that may be transmitted (e.g., wireless, e.g., using Bluetooth) and/or stored.

A bandwidth detector 58' (which may detect the bandwidth of the input signal) may also be used. It may provide the information on active spectrum of the signal. This information may also be used, in some examples, to control the coding tools.

The encoder apparatus 50 may also comprise a long term post filtering tool 57 which may be input with a TD representation of the input signal, e.g., after that the TD representation has been downsampled by a downsampler tool 56.

Figure 6:
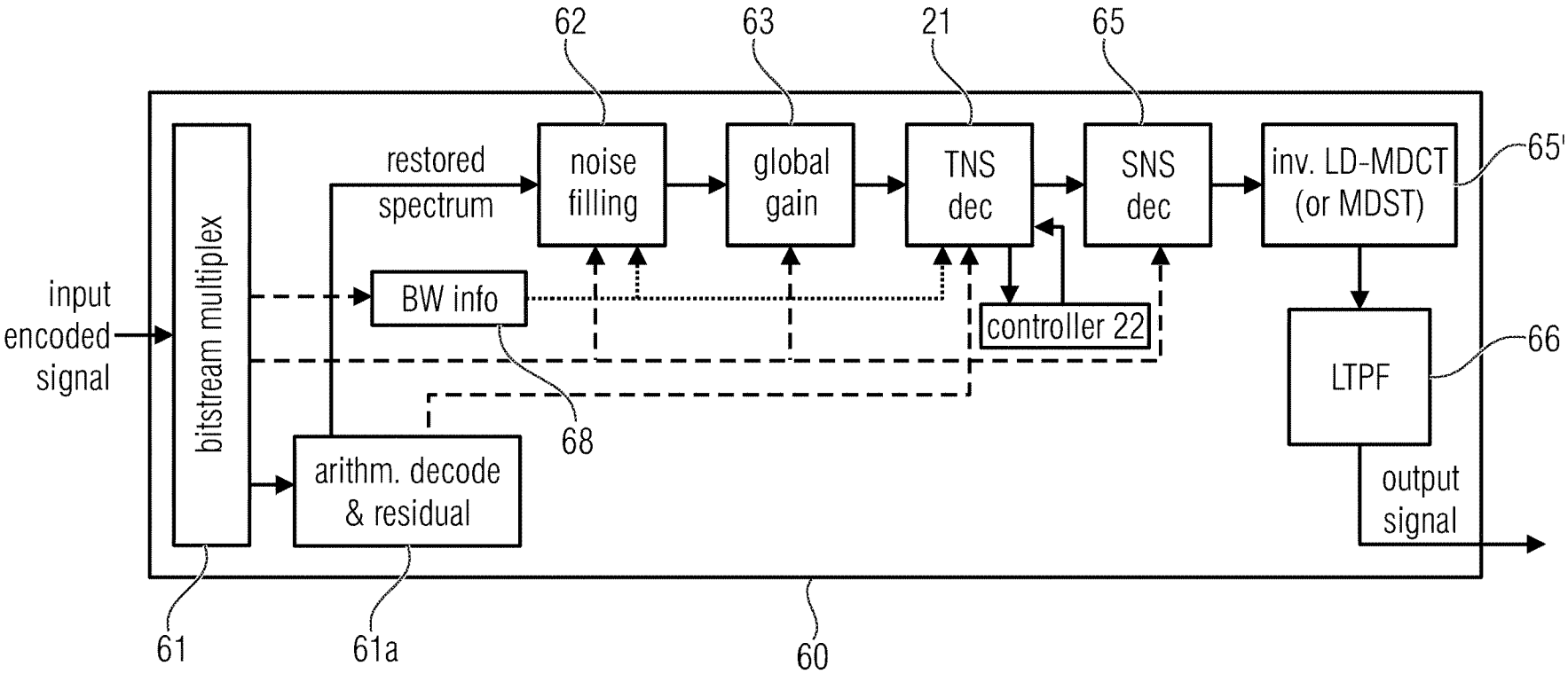
FIG. 6 shows a decoder apparatus according to an example.

An example of decoder apparatus 60 (which may embody the decoder apparatus 20 and/or perform at least some of the operation of the method 40") is shown in FIG. 6.

The decoder apparatus 60 may comprise a reader 61 which may read a bitstream (e.g., as prepared by the apparatus 50). The decoder apparatus 60 may comprise an arithmetic residual decoder 61*a* which may perform, for example, entropy decoding, residual decoding, and/or arithmetic decoding with a digital representation in the FD (restored spectrum), e.g., as provided by the decoder. The decoder apparatus 60 may comprise a noise filing tool 62 and a global gain tool 63, for example. The decoder apparatus 60 may comprise a TNS decoder 21 and a TNS decoder controller 22. The apparatus 60 may comprise an SNS decoder tool 65, for example. The decoder apparatus 60 may comprise an inverse MDCT (or MDST) tool 65' to transform a digital representation of the information signal from the FD to the TD. A long term post filtering may be performed by the LTPF tool 66 in the TD. Bandwidth information 68 may be obtained from the bandwidth detector 58', for example, ad applied to some of the tools (e.g., 62 and 21).

Examples of the operations of the apparatus above are here provided.

Temporal Noise Shaping (TNS) may be used by tool 11 to control the temporal shape of the quantization noise within each window of the transform.

In examples, if TNS is active in the current frame, up to two filters per MDCT-spectrum (or MDST spectrum or other spectrum or other FD representation) may be applied. It is possible to apply a plurality of filters and/or to perform TNS filtering on a particular frequency range. In some examples, this is only optional.

The number of filters for each configuration and the start and the stop frequency of each filter are given in the following table:

| Band-width | num_tns_filters | start_freq(f) | stop_freq(f) | sub_start(f, s) | sub_stop(f, s) |
|---|---|---|---|---|---|
| NB | 1 | {12} | {80} | {{12, 34, 57}} | {{34, 57, 80}} |
| WB | 1 | {12} | {160} | {{12, 61, 110}} | {{61, 110, 160}} |
| SSWB | 1 | {12} | {240} | {{12, 88, 164}} | {{88, 164, 240}} |
| SWB | 2 | {12, 160} | {160, 320} | {{12, 61, 110}, {160, 213, 266}} | {{61, 110, 160}, {213, 266, 320}} |
| FB | 2 | {12, 200} | {200, 400} | {{12, 74, 137}, {200, 266, 333}} | {{74, 137, 200}, {266, 333, 400}} |

Information such as the start and stop frequencies may be signalled, for example, from the bandwidth detector 58'.

Where NB is narrowband, WB is wideband, SSWB is semi-super wideband, SWB is super wideband, and FB is full wideband.

The TNS encoding steps are described in the below. First, an analysis may estimate a set of reflection coefficients for each TNS filter. Then, these reflection coefficients may be quantized. And finally, the MDCT-spectrum (or MDST spectrum or other spectrum or other FD representation) may be filtered using the quantized reflection coefficients.

The complete TNS analysis described below is repeated for every TNS filter f, with f=0 . . . num_tns_filters−1 (num_tns_filters being provided by the table above).

A normalized autocorrelation function may be calculated (e.g., at step S41') as follows, for each k=0 . . . 8

$$r(k)=\begin{cases} r_0(k), & \text{if } \prod_{s=0}^{2} e(s)=0 \\ \sum_{s=0}^{2} \dfrac{\sum_{n=sub_start(f,s)}^{sub_stop(f,s)-1-k} X_s(n)X_s(n+k)}{e(s)}, & \text{otherwise} \end{cases}$$

-continued with $$r_0(k) = \begin{cases} 1, & \text{if } k = 0 \\ 0, & \text{otherwise} \end{cases}$$

and $$e(s) = \sum_{n=sub_start(f,s)}^{sub_stop(f,s)-1} X_s(n)^2 \text{ for } s = 0..2$$

with sub_start(f, s) and sub_stop(f,s) are given in the table above.

The normalized autocorrelation function may be lag-windowed (e.g., at S42') using, for example:

$$r(k)=r(k)\exp[-\tfrac{1}{2}(0.02\pi k)^2] \text{ for } k=0 \ldots 8$$

The Levinson-Durbin recursion described above may be used (e.g., at step S43') to obtain LPC coefficients or other filtering parameters $\alpha(k)$, k=0 . . . 8 and/or a prediction error e.

The decision to turn on/off the TNS filter f in the current frame is based on the prediction gain:

If predGain>thresh, then turn on the TNS filter f

With, for example, thresh=1.5 and the prediction gain being obtained, for example, as:

$$predGain = \frac{r(0)}{e}$$

The additional steps described below are performed only if the TNS filter f is turned on (e.g., if the step S32 has result "YES").

A weighting factor $\gamma$ is computed by $$\gamma = \begin{cases} 1 - (1 - \gamma_{min})\dfrac{\text{thresh2} - predGain}{\text{thresh2} - \text{thresh}}, & \text{if } predGain < \text{thresh2} \\ 1, & \text{otherwise} \end{cases}$$

with thresh2=2, $\gamma_{min}$=0.85 and $$\text{tns_lpc_weighting} = \begin{cases} 1, & \text{if } nbits < 480 \\ 0, & \text{otherwise} \end{cases}$$

The LPC coefficients or other filtering parameters may be weighted (e.g., at step S46') using the factor $\gamma$ $$\alpha_w(k)=\gamma^k\alpha(k) \text{ for } k=0 \ldots 8$$

The weighted LPC coefficients or other filtering parameters may be converted (e.g., at step S47') to reflection coefficients using, for example, the following algorithm:

$a^K(k) = a_w(k), k = 0, \ldots, K$ for $k = K$ to 1 do $rc(k) = a^k(k)$ $e = (1 - rc(k)^2)$ for $n = 1$ to $k - 1$ do $$a^{k-1}(n) = \frac{a^k(n) - rc(k)a^k(k-n)}{e}$$

wherein rc(k,f)=rc(k) are the final estimated reflection coefficients for the TNS filter f.

If the TNS filter f is turned off (e.g., outcome "NO" at the check of step S32), then the reflection coefficients may be simply set to 0: rc(k,f)=0, k=0 . . . 8.

The quantization process, e.g., as performed at step S48', is now discussed.

For each TNS filter f, the reflection coefficients obtained may be quantized, e.g., using scalar uniform quantization in the arcsine domain $$rc_i(k, f) = nint\left[\frac{\arcsin(rc(k, f))}{\Delta}\right] + 8 \text{ for } k = 0..8$$

and $$rc_q(k,f)=\sin[\Delta(rc_i(k,f)-8)] \text{ for } k=0 \ldots 8$$

wherein $$\Delta = \frac{\pi}{17}$$

and nint(.) is the rounding-to-nearest-integer function, for example. $rc_i$(k,f) may be the quantizer output indices and $rc_q$(k,f) may be the quantized reflection coefficients.

The order of the quantized reflection coefficients may be calculated using $k=7$ while k≥0 and $rc_q$(k,f)=0 do $k=k-1$ $rc_{order}(f)=k+1$ The total number of bits consumed by TNS in the current frame can then be computed as follows $$nbits_{TNS} = \left\lceil \sum_{f=0}^{num_tns_filters-1} \frac{2048 + nbits_{TNS_{order}}(f) + nbits_{TNS_{rc}}(f)}{2048} \right\rceil \text{ with}$$

$$nbits_{TNS_{order}}(f) = \begin{cases} \text{ac_tns_order_bits[tns_1pc_weighting]}[rc_{order}(f) - 1], & \text{if } rc_{order}(f) > 0 \\ 0, & \text{otherwise} \end{cases} \text{ and}$$

-continued $$nbits_{TNS_{coef}}(f)=\begin{cases}\sum_{k=0}^{rc_{order}(f)-1} \text{ac_tns_coef_bits}[k][rc_i(k,f)], & \text{if } rc_{order}(f)>0\\ 0, & \text{otherwise}\end{cases}$$

The values of tab_nbits_TNS_order and tab_nbits_TNS_coef may be provided in tables.

The MDCT (or MDST) spectrum $X_s(n)$ (input 15 in FIG. 1) may be filtered using the following procedure:

$s^0(\text{start_freq}(0)-1)=s^1(\text{start_freq}(0)-1)=\ldots=s^7(\text{start_freq}(0)-1)=0$ for f=0 to num_tns_filters−1 do
  for n=start_freq(f) to stop_freq(f)−1 do
    $t^0(n)=s^0(n)=X_s(n)$
    for k=0 to 7 do
      $t^{k+1}(n)=t^k(n)+rc_q(k)s^k(n-1)$
      $s^{k+1}(n)=rc_q(k)t^k(n)+s^k(n-1)$
    $X_f(n)=t^8(n)$ wherein $X_f(n)$ is the TNS filtered MDCT (or MDST) spectrum (output 15 in FIG. 1).

With reference to operations performed at the decoder (e.g., 20, 60), quantized reflection coefficients may be obtained for each TNS filter f using $rc_q(k,f)=\sin[\Delta(rc_i(k,f)-8)]\ k=0\ldots8$ wherein $rc_q(k,f)$ are the quantizer output indices.

The MDCT (or MDST) spectrum $\widehat{X_f}(n)$ as provided to the TNS decoder 21 (e.g., as obtained from the global gain tool 63) may then be filtered using the following algorithm $s^0(\text{start_freq}(0)-1)=s^1(\text{start_freq}(0)-1)=\ldots=s^7(\text{start_freq}(0)-1)=0$ for f=0 to num_tns_filters−1 do
  for n=start_freq(f) to stop_freq(f)−1 do
    $t^K(n)=\widehat{X_f}(n)$
    for k=7 to 0 do
      $t^k(n)=t^{k+1}(n)-rc_q(k)s^k(n-1)$
      $s^{k+1}(n)=rc_q(k)t^k(n)+s^k(n-1)$
    $\widehat{X_s}(n)=s^0(n)=t^0(n)$ wherein $\widehat{X_s}(n)$ is the output of the TNS decoder.

Discussion on the Invention

As explained above, TNS can sometimes introduce artefacts, degrading the quality of the audio coder. These artefacts are click-like or noise-like and appear in most of the cases with speech signals or tonal music signals.

It was observed that artefacts generated by TNS only occur in frames where the prediction gain predGain is low and close to a threshold thresh.

One could think that increasing the threshold would easily solve the problem. But for most of the frames, it is actually beneficial to turn on TNS even when the prediction gain is low.

Our proposed solution is to keep the same threshold but to adjust the TNS filter when the prediction gain is low, so as to reduce the impulse response energy.

There are many ways to implement this adjustment (which is some cases may be referred to as "attenuation", e.g., when the reduction of impulse response energy is obtained by reducing the LP filter parameters, for example). We may choose to use weighting, which may be, for example, a weighting $a_w(k)=\gamma^k a(k), k=0,\ldots,K$ with a(k) are the LP filter parameters (e.g., LPC coefficients) computed in Encoder Step c) and a_w (k) are the weighted LP filter parameters. The adjustment (weighting) factor γ is made dependent on the prediction gain such that higher reduction of impulse response energy (γ<1) is applied for lower prediction gains and such that there is, for example, no reduction of impulse response energy (γ=1) for higher prediction gains.

The proposed solution was proven to be very effective at removing all artefacts on problematic frames while minimally affecting the other frames.

Figure 8A:
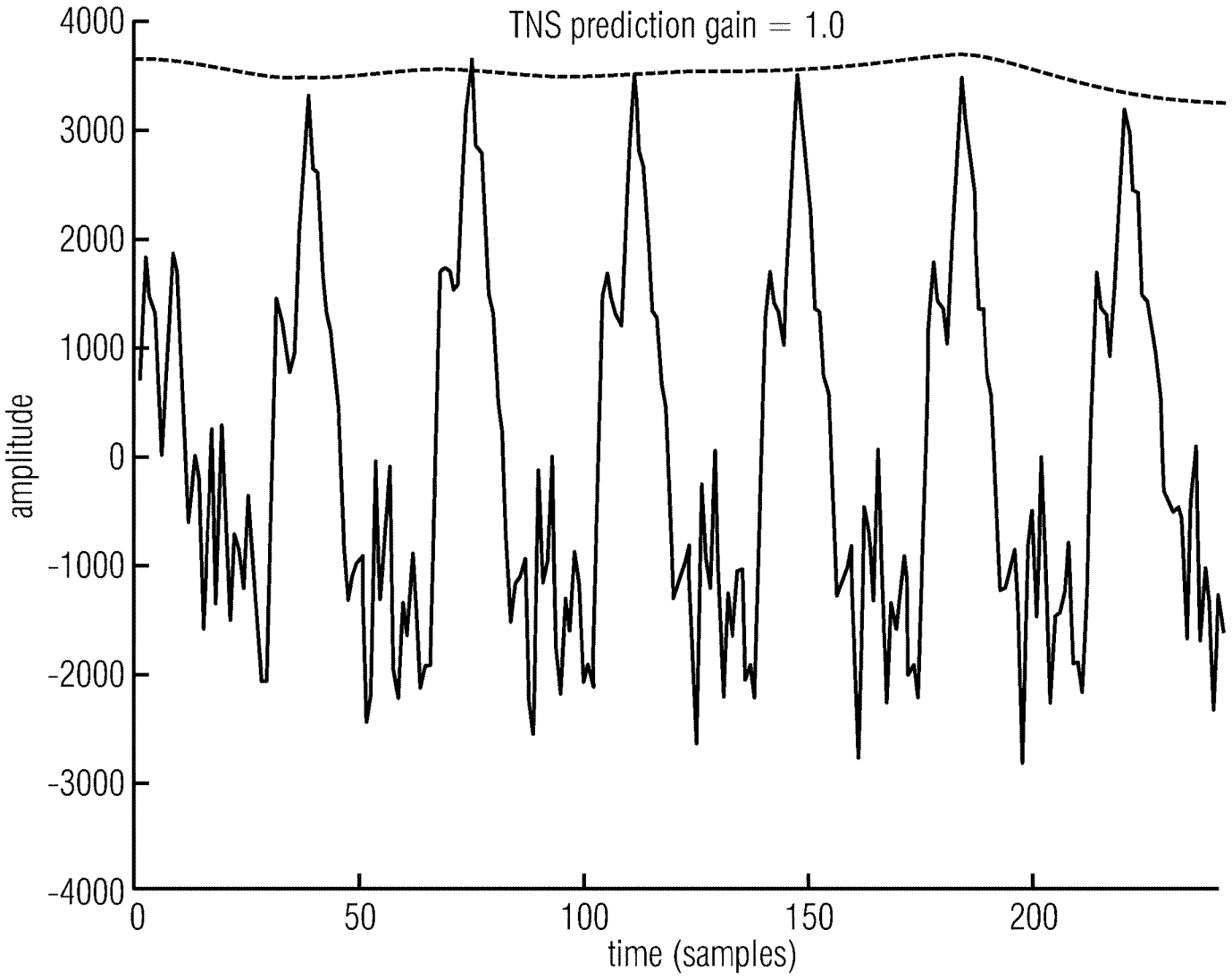
FIGS. 8A to 8C show signal evolutions according to examples.
Figure 8B:
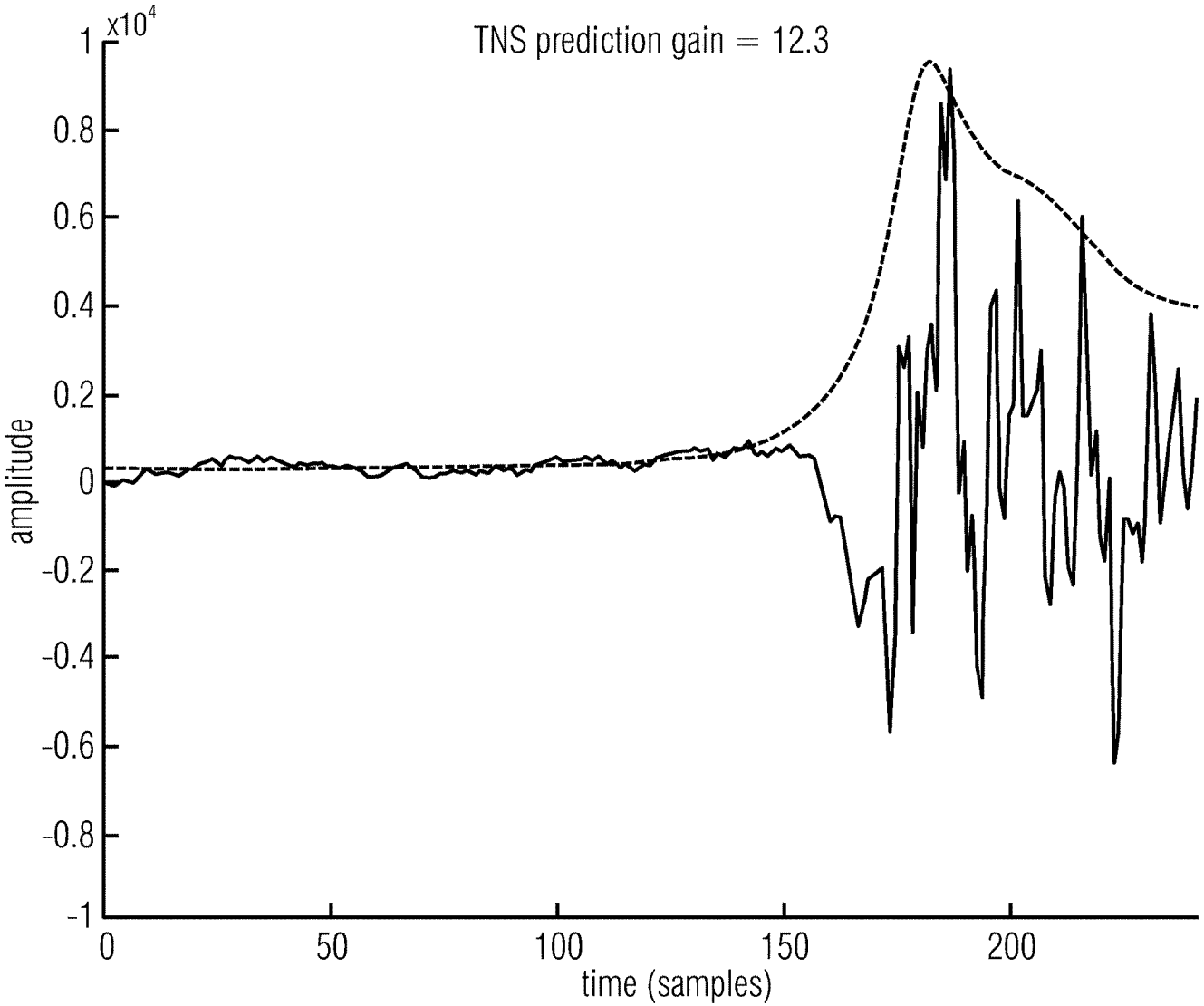
Figure 8C:
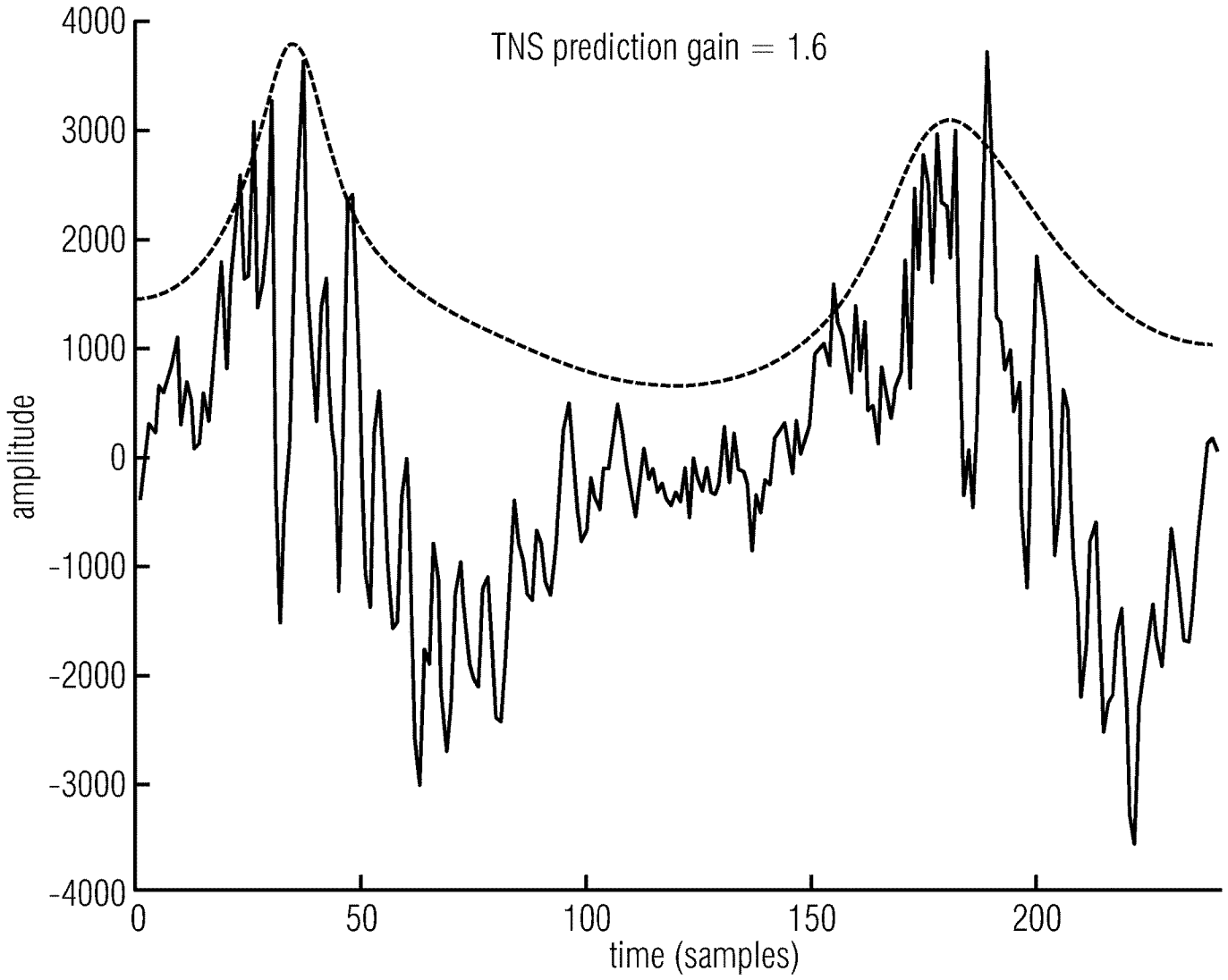

Reference can now be made to FIGS. 8A-8C. The figures show a frame of audio signal (continuous line) and the frequency response (dashed line) of the corresponding TNS prediction filter.

FIG. 8A: castanets signal

FIG. 8B: pitch pipe signal

FIG. 8C: speech signal

The prediction gain is related to the flatness of the signal's temporal envelope (see, for example, Section 3 of ref [2] or Section 1.2 of ref [3]).

A low prediction gain implies a tendentially flat temporal envelope, while a high prediction gain implies an extremely un-flat temporal envelope.

FIG. 8A shows the case of a very low prediction gain (predGain=1.0). It corresponds to the case of a very stationary audio signal, with a flat temporal envelope. In this case predGain=1<thresh (e.g., thresh=1.5): no filtering is performed (S33).

FIG. 8B shows the case of a very high prediction gain (12.3). It corresponds to the case of a strong and sharp attack, with a highly un-flat temporal envelope. In this case predGain=12.3>thresh2 (threh2=2): higher impulse response energy filtering is performed at S36.

FIG. 8C shows the case of a prediction gain between thresh and thresh2, e.g., in a 1.5-2.0 range (higher than the first threshold, lower than the second threshold). It corresponds to the case of a slightly un-flat temporal envelope. In this case thresh<predGain<thresh2: lower impulse response energy filtering is performed at S35, using the second filter 15*a* with lower impulse response energy.

Other Examples

Figure 7:
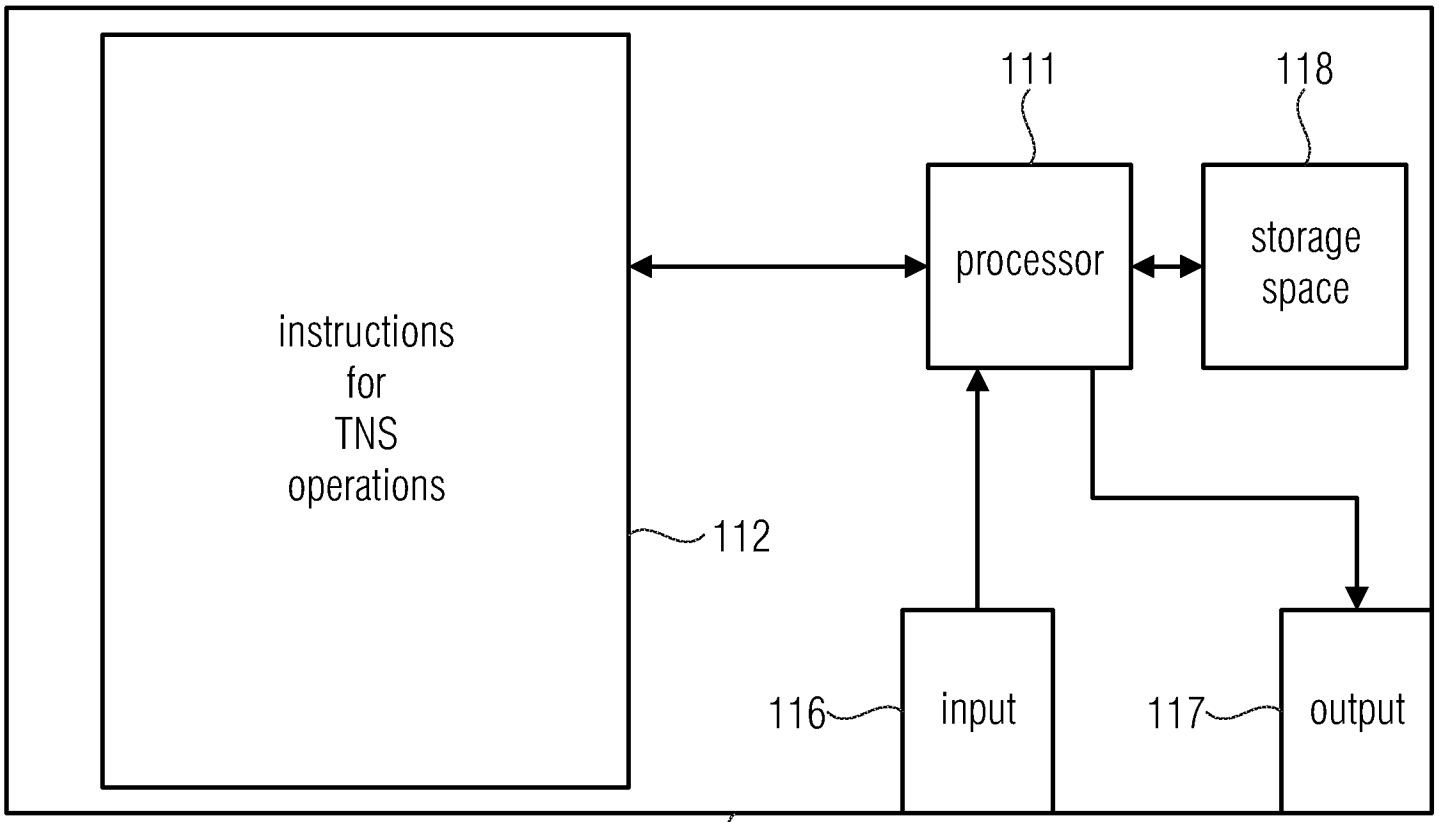
FIG. 7 shows an encoder apparatus according to an example.

FIG. 7 shows an apparatus 110 which may implement the encoding apparatus 10 or 50 and/or perform at least some steps of the method 30 and/or 40'. The apparatus 110 may comprise a processor 111 and a non-transitory memory unit 112 storing instructions which, when executed by the processor 111, may cause the processor 111 to perform a TNS filtering and/or analysis. The apparatus 110 may comprise an input unit 116, which may obtain an input information signal (e.g., an audio signal). The processor 111 may therefore perform TNS processes.

Figure 9:
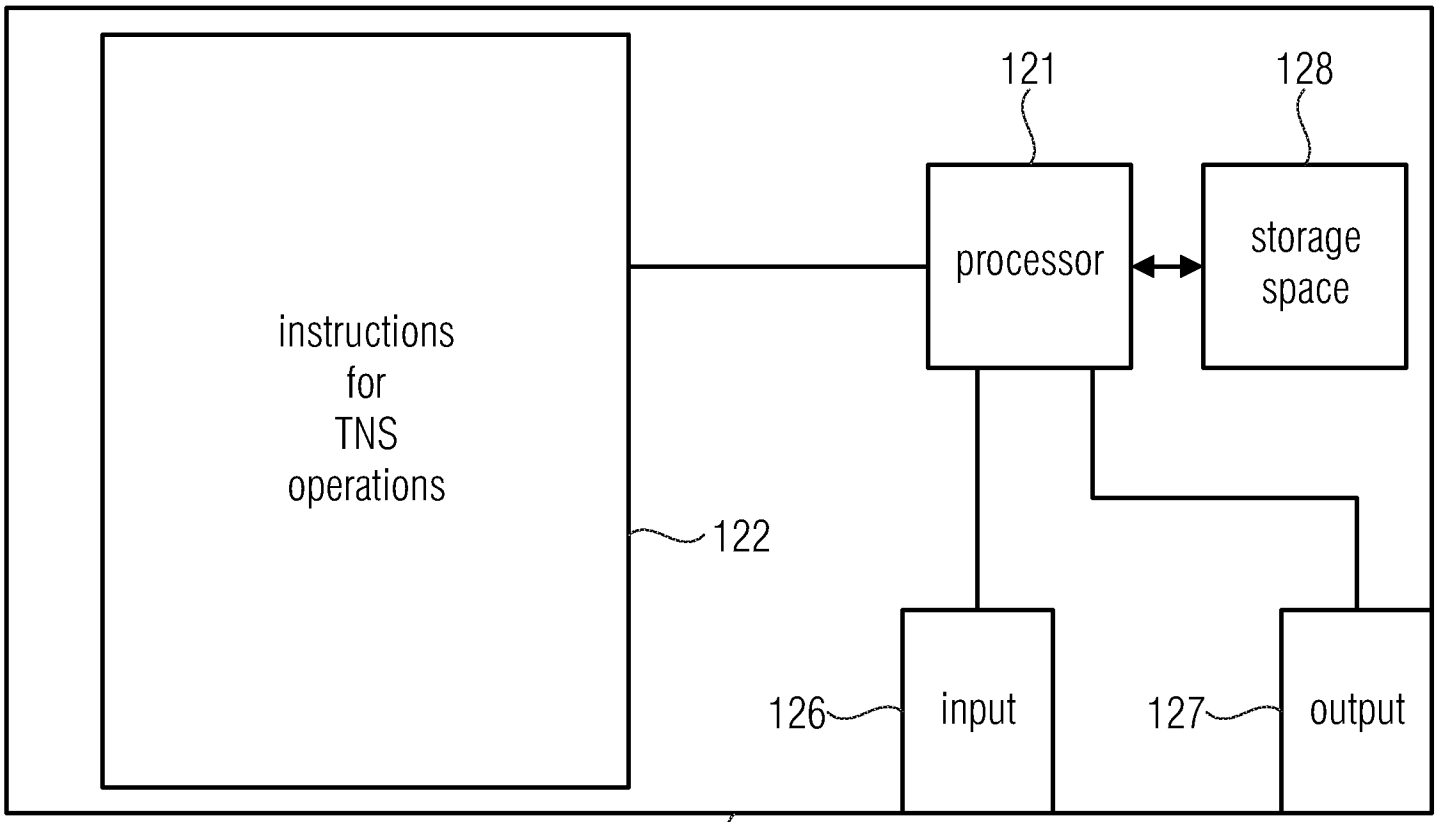
FIG. 9 shows an encoder apparatus according to an example.

FIG. 9 shows an apparatus 120 which may implement the decoder apparatus 20 or 60 and/or perform the method 40'. The apparatus 120 may comprise a processor 121 and a non-transitory memory unit 122 storing instructions which, when executed by the processor 121, may cause the processor 121 to perform, inter alia, a TNS synthesis operation. The apparatus 120 may comprise an input unit 126, which may obtain a decoded representation of an information signal (e.g., an audio signal) in the FD. The processor 121 may therefore perform processes to obtain a decoded representation of the information signal, e.g., in the TD. This decoded representation may be provided to external units using an output unit 127. The output unit 127 may comprise, for example, a communication unit to communicate to external devices (e.g., using wireless communication, such as Bluetooth) and/or external storage spaces. The processor 121 may save the decoded representation of the audio signal in a local storage space 128. In examples, the systems 110 and 120 may be the same device.

Depending on certain implementation requirements, examples may be implemented in hardware. The implementation may be performed using a digital storage medium, for example a floppy disk, a Digital Versatile Disc (DVD), a Blu-Ray Disc, a Compact Disc (CD), a Read-only Memory (ROM), a Programmable Read-only Memory (PROM), an Erasable and Programmable Read-only Memory (EPROM), an Electrically Erasable Programmable Read-Only Memory (EEPROM) or a flash memory, having electronically readable control signals stored thereon, which cooperate (or are capable of cooperating) with a programmable computer system such that the respective method is performed. Therefore, the digital storage medium may be computer readable.

Generally, examples may be implemented as a computer program product with program instructions, the program instructions being operative for performing one of the methods when the computer program product runs on a computer. The program instructions may for example be stored on a machine readable medium.

Other examples comprise the computer program for performing one of the methods described herein, stored on a machine readable carrier. In other words, an example of method is, therefore, a computer program having a program instructions for performing one of the methods described herein, when the computer program runs on a computer.

A further example of the methods is, therefore, a data carrier medium (or a digital storage medium, or a computer-readable medium) comprising, recorded thereon, the computer program for performing one of the methods described herein. The data carrier medium, the digital storage medium or the recorded medium are tangible and/or non-transitionary, rather than signals which are intangible and transitory.

A further example comprises a processing unit, for example a computer, or a programmable logic device performing one of the methods described herein.

A further example comprises a computer having installed thereon the computer program for performing one of the methods described herein.

A further example comprises an apparatus or a system transferring (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some examples, a programmable logic device (for example, a field programmable gate array) may be used to perform some or all of the functionalities of the methods described herein. In some examples, a field programmable gate array may cooperate with a microprocessor in order to perform one of the methods described herein. Generally, the methods may be performed by any appropriate hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An encoder apparatus comprising:

a temporal noise shaping, TNS, tool for performing linear prediction, LP, filtering on an information signal comprising a plurality of frames; and a controller configured to control the TNS tool so that the TNS tool performs LP filtering with:

a first filter whose impulse response comprises a higher energy; and a second filter whose impulse response comprises a lower energy, wherein the second filter is not an identity filter, wherein the controller is configured to choose between filtering with the first filter and filtering with the second filter on the basis of a frame metrics, wherein the controller is further configured to: modify the first filter so as to acquire the second filter in which the filter's impulse response energy is reduced.

2. The encoder apparatus of claim 1, wherein the controller is further configured to:

apply an adjustment factor to the first filter to acquire the second filter.

3. The encoder apparatus of claim 2, configured to modify the first filter to acquire the second filter by modifying the amplitude of the parameters of the first filter using an adjustment factor.

4. The encoder apparatus of claim 2, wherein the controller is further configured to:

define the adjustment factor on the basis of a filtering type determination threshold used for selecting between filtering with the first filter and filtering with the second filter.

5. The encoder apparatus of claim 2, wherein the controller is further configured to:

define the adjustment factor on the basis of at least the frame metrics.

6. The encoder apparatus of claim 2, wherein the controller is further configured to:

define the adjustment factor on the basis of a TNS filtering determination threshold which is used for selecting between performing TNS filtering and non-performing TNS filtering.

7. The encoder apparatus of claim 2, wherein the controller is further configured to:

define the adjustment factor using a linear function of the frame metrics, the linear function being such that an increase in the frame metrics corresponds to an increase of the adjustment factor and/or of the filter's impulse response energy.

8. The encoder apparatus of claim 2, configured to define the adjustment factor as $$\gamma = \begin{cases} 1 - (1 - \gamma_{min})\dfrac{\text{thresh2} - frameMetrics}{\text{thresh2} - \text{thresh}}, & \text{if } frameMetrics < \text{thresh2} \\ 1, & \text{otherwise} \end{cases}$$

wherein thresh is the TNS filtering determination threshold, thresh2 is the filtering type determination threshold, frameMetrics is a frame metrics, and $\gamma_{min}$ is a fixed value.

9. The encoder apparatus of claim 2, configured to modify the parameters of the first filter to acquire the parameters of the second filter by applying:

$$\alpha_w(k)=\gamma^k\alpha(k),\ k=0,\ldots,K$$

where a(k) are parameters of the first filter, $\gamma$ is the adjustment factor such that $0<\gamma<1$, $a_w(k)$ are the parameters of the second filter and K is the order of the first filter.

10. The encoder apparatus of claim 1, wherein the controller is further configured to:

acquire the frame metrics from at least one of a prediction gain, an energy of the information signal and/or a prediction error.

11. The encoder apparatus of claim 1, wherein the frame metrics comprises a prediction gain calculated as $$predGain = \frac{\text{energy}}{predError}$$

where energy is a term associated to an energy of the information signal, and predError is a term associated to a prediction error.

12. The encoder apparatus of claim 1, wherein the controller is configured so that:

at least for a reduction of a prediction gain and/or a reduction of an energy of the information signal, the second filter's impulse response energy is reduced, and/or at least for an increase of the prediction error, the second filter's impulse response energy is reduced.

13. The encoder apparatus of claim 1, wherein the controller is further configured to:

compare the frame metrics with a filtering type determination threshold, so as to perform a filtering with the first filter when the frame metrics is lower than the filtering type determination threshold.

14. The encoder apparatus of claim 1, wherein the controller is further configured to:

choose between performing a filtering and non-performing filtering on the basis of the frame metrics.

15. The encoder apparatus of claim 14, wherein the controller is further configured to:

compare the frame metrics with a TNS filtering determination threshold, so as to choose to avoid TNS filtering when the frame metrics is lower than the TNS filtering determination threshold.

16. The encoder apparatus of claim 1, further comprising:

a bitstream writer to prepare a bitstream with reflection coefficients, or a quantized version thereof, acquired by the TNS tool.

17. The encoder apparatus of claim 1, the filtering parameters of the first filter being chosen between LP coding, LPC, coefficients and/or any other representation of the filter coefficients.

18. The encoder apparatus of claim 1, wherein the information signal is an audio signal.

19. The encoder apparatus according to claim 1, wherein the controller is further configured to modify the first filter so as to acquire the second filter in which the filter's impulse response energy is reduced.

20. The encoder apparatus of claim 1, wherein the frame metrics is associated to the flatness of the signal's temporal envelope.

21. A method for performing temporal noise shaping, TNS, filtering on an information signal comprising a plurality of frames, the method comprising:

for each frame, choosing between filtering with a first filter and filtering with a second filter, whose impulse response comprises a lower energy, on the basis of a frame metrics, wherein the second filter is not an identity filter;

filtering the frame using the filtering with the filtering chosen between filtering with the first filter and filtering with the second filter; and modify the first filter so as to acquire the second filter in which the filter's impulse response energy is reduced.

22. A non-transitory digital storage medium having a computer program stored thereon to perform the method for performing temporal noise shaping, TNS, filtering on an information signal comprising a plurality of frames, the method comprising:

for each frame, choosing between filtering with a first filter and filtering with a second filter, whose impulse response comprises a lower energy, on the basis of a frame metrics, wherein the second filter is not an identity filter;

filtering the frame using the filtering with the filtering chosen between filtering with the first filter and filtering with the second filter; and modify the first filter so as to acquire the second filter in which the filter's impulse response energy is reduced, when said computer program is run by a computer.

* * * * *